US012630330B2

(12) United States Patent
Schuver

(10) Patent No.: US 12,630,330 B2
(45) Date of Patent: May 19, 2026

(54) CLOSURE FOR A BEVERAGE CAN LID

(71) Applicant: SBH, Inc., Saint Louis, MO (US)

(72) Inventor: Steven Schuver, Saint Louis, MO (US)

(73) Assignee: SBH, Inc., Saint Louis, MO (US)

( * ) Notice: Subject to any disclaimer, the term of this patent is extended or adjusted under 35 U.S.C. 154(b) by 0 days.

(21) Appl. No.: 19/048,556

(22) Filed: Feb. 7, 2025

(65) Prior Publication Data

US 2025/0178780 A1 Jun. 5, 2025

Related U.S. Application Data

(63) Continuation-in-part of application No. 18/236,758, filed on Aug. 22, 2023, now Pat. No. 12,246,893.

(51) Int. Cl.
*B65D 17/28* (2006.01)

(52) U.S. Cl.
CPC .. *B65D 17/4014* (2018.01); *B65D 2517/0041* (2013.01)

(58) Field of Classification Search
CPC ..... B65D 51/007; B65D 51/02; B65D 2517/0004; B65D 1/32; B65D 7/04; B65D 15/02; B65D 17/02; B65D 17/523; B65D 17/4014; B65D 2517/0041; B65D 2517/0014; B65D 2517/0062
See application file for complete search history.

(56) References Cited

U.S. PATENT DOCUMENTS 3,805,989 A 4/1974 Walker
3,967,752 A 7/1976 Cudzik
4,339,053 A * 7/1982 Tarro ..... B65D 55/02 220/269
4,433,792 A 2/1984 Mandel
4,842,159 A * 6/1989 Heidrich ..... B65D 51/007 220/714
4,880,136 A * 11/1989 Englert ..... B65D 17/4012 220/253
4,887,712 A 12/1989 Wells
5,285,924 A * 2/1994 Morris ..... B65D 17/4014 220/729
5,351,853 A * 10/1994 Shock ..... B65D 51/007 220/729
5,452,818 A 9/1995 Yost
5,813,559 A * 9/1998 Cho ..... B65D 17/4014 220/269
6,032,816 A * 3/2000 Martin ..... B65D 51/007 220/284
6,626,314 B1 * 9/2003 McHenry ..... B65D 47/265 220/255
9,315,305 B2 4/2016 Robinson
2004/0256388 A1 12/2004 Rossetti et al.
(Continued)

*Primary Examiner* — Kareen K Thomas
(74) *Attorney, Agent, or Firm* — David H. Chervitz

(57) ABSTRACT

A closure for a beverage can lid has a body having a back end and a front end with the front end having a first ear section having a first rounded section, a first indented portion, and a first lobe section, a second ear section having a second rounded section, a second indented portion, and a second lobe section, a central rounded section having a rivet opening formed therein and the central rounded section positioned between the first ear section and the second ear section, a first central section having a first step down section, and a second central section having a second step down section.

20 Claims, 21 Drawing Sheets

(56) References Cited

U.S. PATENT DOCUMENTS

| | | | | |
|---|---|---|---|---|
| 2011/0232423 | A1* | 9/2011 | Raymond | B65D 51/007 81/3.55 |
| 2013/0087563 | A1 | 4/2013 | Brandtner | |
| 2020/0299055 | A1 | 9/2020 | Ritzenhoff | |
| 2020/0307856 | A1 | 10/2020 | Pawezka | |
| 2022/0089319 | A1 | 3/2022 | Schuver | |

* cited by examiner

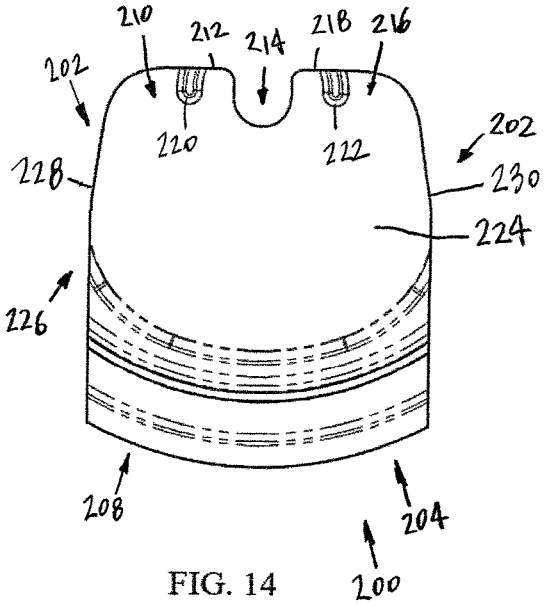
FIG. 14
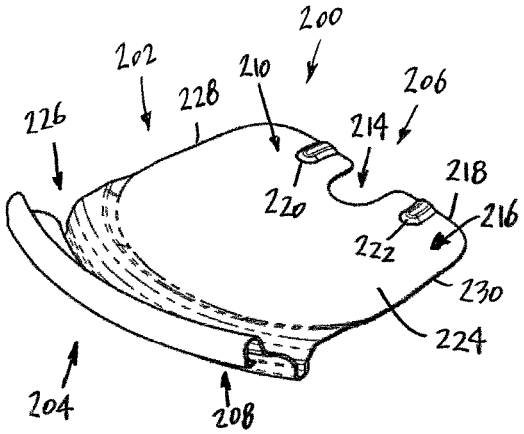
FIG. 13
FIG. 15
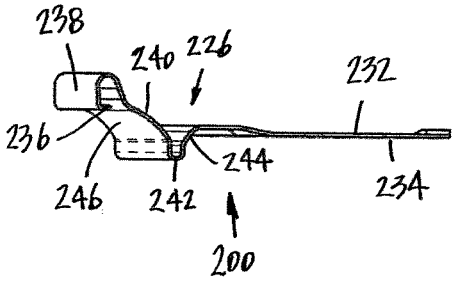

CLOSURE FOR A BEVERAGE CAN LID

CROSS REFERENCE TO RELATED APPLICATIONS

This application is a continuation-in-part of U.S. patent application Ser. No. 18/236,758 filed on Aug. 22, 2023, the disclosure of which is incorporated herein by reference.

BACKGROUND

This disclosure relates generally to a closure for a beverage can lid having an opening, and more particularly to a closure for a beverage can lid for covering the opening.

Beverage cans for containing liquids such as carbonated beverages have become a universal and ubiquitous product. The beverage can is typically constructed of an aluminum alloy composition that may include aluminum, magnesium, manganese, silicon, and copper. The beverage can consists of a can body into which a liquid is filled and a can lid or end that is sealed to the can body. The can body may include a base or bottom that is dome shaped to resist internal pressure, a generally cylindrical section, a narrowed neck portion, and an open top edge. The can lid may include the lid portion that is about the same circumference as the narrowed neck portion of the can body, a scored line or weakened portion cut into the lid portion to form a panel or a tear panel having a hinge, a tab portion that is used to rupture the lid portion along the scored line to create an opening, a rivet that is used to secure the tab to the lid portion, and various strengthening features such as a teardrop or figure eight. The rivet is an integral piece of the lid portion and is formed by stretching the center of the lid portion upwardly and then drawn to form the rivet. The lid is sealed to the can body by trimming the open top edge of the can body, bending the trimmed edge, and seaming the bent trimmed edge to the lid. In this manner, any liquid contained within the can body is sealed. To open the beverage can the tab is lifted to press against the tear panel to partially push the tear panel into the can body to create the opening in the lid. The panel does not fully detach from the lid due to the hinge formed in the lid by ends of the score line. Once opened, liquid from inside the can body may flow through the opening.

One problem associated with the use of the beverage can is that once opened it cannot be closed again. Since the liquid within the beverage can may be carbonated, after a period of time the carbonation escapes and the liquid becomes flat or stale. Once flat, the beverage can and its contents may be discarded which may be wasteful. Also, after opening the beverage can the contents may have to be consumed quickly because the contents cannot be preserved. Further, it is also possible that the contents of the beverage can may spill due to not being able to close the opening. In particular, when an individual is walking with an opened beverage can the individual may trip or fall and the contents of the can may be spilled because the can is open. This may also be problematic if the beverage can is stationary and near electrical equipment such as a computer or a laptop and the can is accidentally knocked over. It is also possible that insects, contaminants, or other unwanted matter may infiltrate the beverage can through the opening. If this occurs, then the beverage can and its contents should be thrown away, discarded, or recycled.

Another problem associated with the use of a beverage can is a portion of the lid is not protected from becoming contaminated with dirt, dust, or other debris during manufacturing, transportation, storage, or display of the beverage can. In particular, dirt may accumulate on the lid near where the panel detaches from the lid to form the opening. If this occurs then the lid has to be cleaned to present a hygienic surface from which to drink the beverage in the beverage can. Some individuals find it unacceptable to drink from the beverage can in which the lid has been contaminated and will not purchase the beverage can.

A further problem associated with the use of a beverage can is that some individuals find it difficult to grasp the tab in order to open the beverage can. During the manufacturing process the tab is held to the lid by forming a rivet. The process of forming the rivet presses the tab directly against the lid. When this occurs the tab may be pressed against the lid making the tab difficult to grip to be able to lift up the tab.

The present disclosure is designed to obviate and overcome many of the disadvantages and shortcomings experienced with prior beverage can constructions. Particularly, it would be advantageous to be able to have a closure for a beverage can lid for preserving the contents of the beverage can. Moreover, the present disclosure is related to a closure for a beverage can lid that can be used to reseal the beverage can for later use, to prevent spillage, or to prevent contaminants from entering the can once opened. It would also be advantageous to have a closure for a beverage can for preventing contaminants from accumulating near the tear panel. Further, it would be advantageous to have a closure for a beverage can that lifts the tab to provide for easier grasping of the tab to open the beverage can.

SUMMARY

In one form of the present disclosure, a closure for a beverage can lid is disclosed which comprises a body having a back end and a front end with the front end having a first ear section having a first rounded section, a first indented portion, and a first lobe section, a second ear section having a second rounded section, a second indented portion, and a second lobe section, a central rounded recess positioned between the first ear section and the second ear section, a first central section having a first step down section, a second central section having a second step down section, a track portion having a first lip portion and a first generally inverted U-shaped track portion having an arched segment and a generally U-shaped portion, the track portion further having a second lower lip portion and a second generally inverted U-shaped track portion, and a finger grab portion positioned between the first generally inverted U-shaped track portion and the second generally inverted U-shaped track portion.

In another form of the present disclosure, a closure for a beverage can lid comprises a body having a back end and a front end with the front end having a first ear section having a first rounded section, a first indented portion, and a first lobe section, a second ear section having a second rounded section, a second indented portion, and a second lobe section, a central rounded recess positioned between the first ear section and the second ear section, a first central section having a first step down section, a second central section having a second step down section, a track portion having a first lip portion and a first generally inverted U-shaped track portion having an arched segment and a generally U-shaped portion, and a surface positioned on the first generally inverted U-shaped track portion.

In still another form of the present disclosure, a closure for a beverage can lid comprises a body having a back end and a front end with the front end having a first ear section having a first rounded section, a first indented portion, and a first lobe section, a second ear section having a second rounded section, a second indented portion, and a second lobe section, a central rounded recess positioned between the first ear section and the second ear section, a first central section having a first step down section, a second central section having a second step down section, a track portion having a first lip portion and a first generally inverted U-shaped track portion having an arched segment and a generally U-shaped portion, and a knurled portion positioned on the first generally U-shaped track portion.

In light of the foregoing comments, it will be recognized that the closure for a beverage can lid of the present disclosure is of simple construction and design and which can be easily employed with highly reliable results.

The present disclosure provides a closure for a beverage can lid that may be used to reseal or close an opened beverage can to preserve the contents of the beverage can for later use.

The present disclosure provides a closure for a beverage can lid that employs an easy to use closure mechanism that allows an individual to reseal or close the lid of an opened beverage can.

The present disclosure is directed to a closure for a beverage can lid that is hygienic and provides a sanitary closure mechanism.

The present disclosure provides a closure for a beverage can lid that does not require any special tools to close or open the beverage can lid.

The present disclosure also provides a closure for a beverage can lid that can be used with any sized beverage can.

The present disclosure provides a closure for a beverage can lid that can be constructed using readily available materials and construction techniques and machinery.

The present disclosure also provides a closure for a beverage can lid having a closure mechanism that may be added to a beverage can after the beverage can has been manufactured.

The present disclosure is also directed to a closure for a beverage can lid that can be used to open and close the lid of an opened beverage can several times.

The present disclosure is also directed to a closure for a beverage can lid that does not interfere with the operation of a tab connected to the beverage can lid.

The present disclosure is further directed to a closure for a beverage can lid that can be moved from an opened position to a closed position to reseal the beverage can lid.

The present disclosure also provides a closure for a beverage can lid that may be constructed of a thinner metal than the beverage can lid.

The present disclosure provides a closure for a beverage can lid that facilitates easy grasping of a tab connected to the beverage can lid to allow the tab to be easily grasped by an individual to easily open the beverage can lid.

These and other advantages of the present disclosure will become apparent after considering the following detailed specification in conjunction with the accompanying drawings, wherein:

BRIEF DESCRIPTION OF THE DRAWINGS

FIG. 13 is a perspective view of another embodiment of a closure for a beverage can lid constructed according to the present disclosure;

FIG. 14 is a top view of the closure for a beverage can lid shown in FIG. 13;

FIG. 15 is a side view of the closure for a beverage can lid shown in FIG. 13;

DETAILED DESCRIPTION OF A PREFERRED EMBODIMENT

Figure 2:
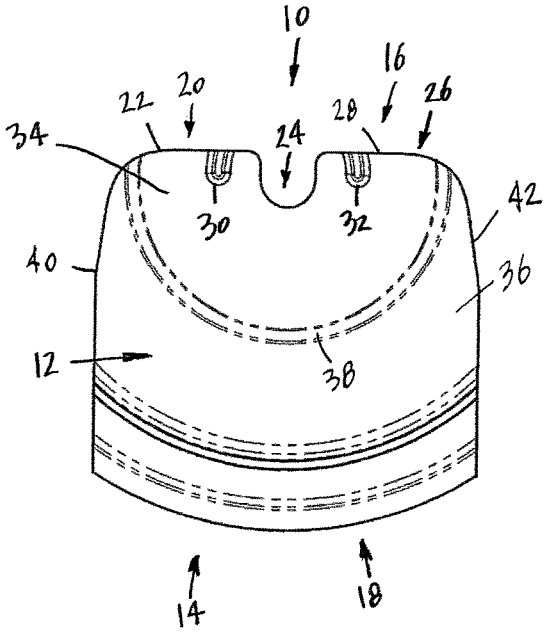
FIG. 2 is a top view of the closure for a beverage can lid shown in FIG. 1.
Figure 1:
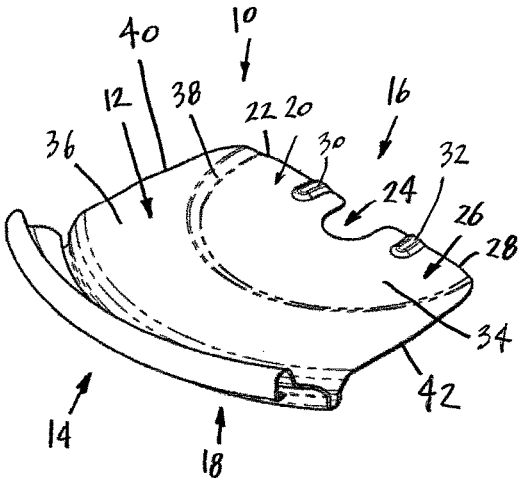
FIG. 1 is a perspective view of a closure for a beverage can lid constructed according to the present disclosure.

Referring now to the drawings, wherein like numbers refer to like items, number 10 identifies a preferred embodiment of a closure for a beverage can lid constructed according to the present disclosure. Referring now to FIGS. 1 and 2, the closure 10 is shown to comprise a body 12 having a back end 14 and a front end 16. The back end 14 has a track portion 18 that is used to ride, slide, or move along a rim (not shown) of a beverage can lid (not shown). The front end 16 has a first or left tooth or ear section 20 having a left front edge 22, a central rounded recess or slot 24, and a second or right tooth or ear section 26 having a right front edge 28. The first section 20 has a left nub or rib portion 30 at the left front edge 22 and the second portion 26 has a right nub or rib portion 32 at the right front edge 28. The rib portions 30 and 32 are shorter than the central rounded recess 24. Although the rib portions 30 and 32 are shown it is possible that the closure 10 may not require the rib portions 30 and 32. The body 12 also has a front panel portion 34, a rear panel portion 36, and a step down section 38 between the front panel portion 34 and the rear panel portion 36, a left edge 40, and a right edge 42. The step down section 38 is curved or arcuate in shape and spans from the left front edge 22 to the right front edge 28. The track portion 18 is also curved or arcuate in shape and is adapted to fit around a rim (not shown), as will be described in further detail herein.

Figure 3:
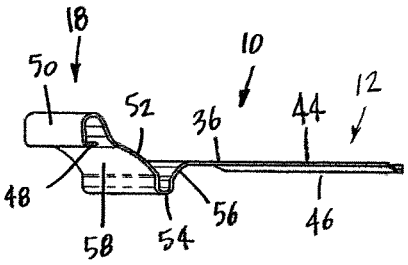
FIG. 3 is a side view of the closure for a beverage can lid shown in FIG. 1.

FIG. 3 shows a side perspective of the closure for a beverage can lid 10 constructed according to the present disclosure. The closure 10 has the body 12 having a top surface 44 and a bottom surface 46. The bottom surface 46 is adapted to engage with or cover a beverage can lid (not shown). The track portion 18 has a lower lip portion 48 and a generally inverted U-shaped portion 50. The U-shaped portion 50 continues to an arched segment 52 and a generally U-shaped portion 54. The generally U-shaped portion 54 continues to an angled segment 56 and to the rear panel portion 36. The track portion 18, the arched segment 52, and the generally U-shaped portion 54 have a bottom surface 58 that is adapted to engage with or cover a rim (not shown) of a beverage can (not shown). The closure 10 is of unitary construction in that the body 12, the track portion 18, the arched segment 52, the generally U-shaped portion 54, and the angled segment 56 are formed from one piece of material.

Figure 5:
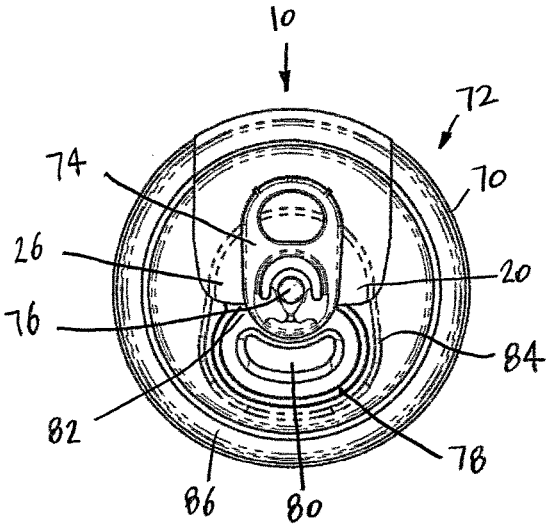
FIG. 5 is a top view of the closure for a beverage can lid constructed according to the present disclosure with the closure in an initial position and the beverage can lid unopened.
Figure 4:
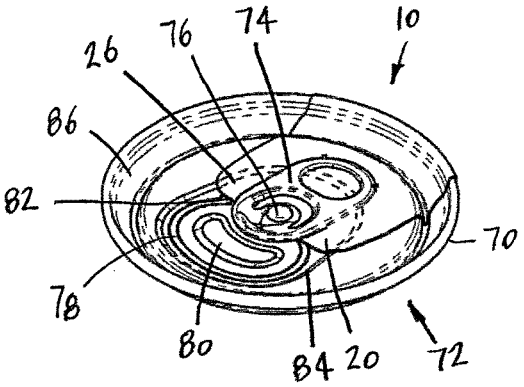
FIG. 4 is a perspective view of the closure for a beverage can lid constructed according to the present disclosure with the closure in an initial position and the beverage can lid unopened.

With reference now to FIGS. 4 and 5, the closure 10 is illustrated being positioned on a rim 70 of a beverage can lid 72. The beverage can lid 72 has a tab 74 that is staked to a rivet 76. A score line 78 is formed in the beverage can lid 72 which defines a tear panel 80. The tear panel 80 is adapted to be partially detached from the beverage can lid 72 and is held to the beverage can lid 72 by use of a hinge 82. The beverage can lid 72 also has an indented area 84 with such indented area 84 being in the shape of a teardrop or a figure eight. In operation, the tab 74 is lifted to press into the tear panel 80 to open the beverage can lid 72 by rupturing the tear panel 80 along the score line 78. Once opened, the contents of a beverage can (not shown) may be removed through an opening (not shown) formed by partially detaching the tear panel 80. The closure 10 is shown being in an initial position in which the beverage can lid 72 is not opened and the closure 10 is not covering the tear panel 80. Although the initial position is depicted in FIGS. 4 and 5 as being at the 12 o'clock position it is possible and contemplated that the initial position may be at any location around the rim 70. In the initial position the closure 10 is not preventing the tab 74 from being lifted or used. The closure 10 is positioned on the rim 70 and is capable of moving or sliding along the rim 70 to move the closure 10 from the initial position. The body 12 of the closure 10 is positioned below the tab 74 with the left ear section 20 and the right ear section 26 being underneath the tab 74. Although hidden in these particular views, the central rounded recess 24 fits around the rivet 76. The rim 70 also has a surface 86 against which the bottom surface 58 (FIG. 3) of the closure 10 slides upon during use. As can be appreciated, the shape of the track portion 18 (FIGS. 1, 2, and 3) is similar to the shape of the rim 70 and the shape of the U-shaped portion 50, the arched segment 52, and the generally U-shaped portion 54 are similar to the shape of the surface 86. This allows the closure 10 to easily slide along the rim 70.

Figure 7:
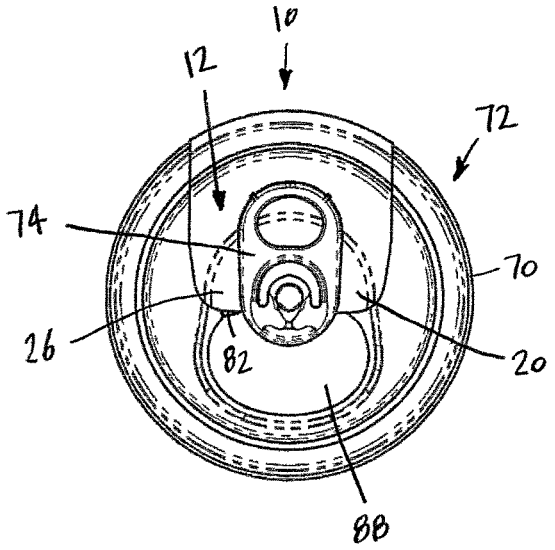
FIG. 7 is a top view of the closure for a beverage can lid constructed according to the present disclosure with the closure in an initial position and the beverage can lid opened.
Figure 6:
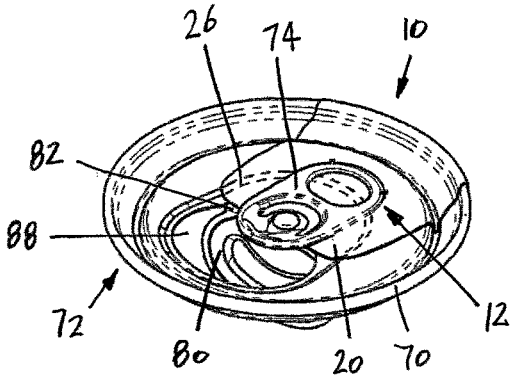
FIG. 6 is a perspective view of the closure for a beverage can lid constructed according to the present disclosure with the closure in an initial position and the beverage can lid opened.

FIGS. 6 and 7 depict the beverage can lid 72 being opened and the closure 10 being in the initial position. In this configuration, the tab 74 has been used to rupture or detach the tear panel 80 to form an opening 88 in the beverage can lid 72. The closure 10 has not interfered with the operation of the tab 74. The tear panel 80 is held to the beverage can lid 72 by use of the hinge 82. In this manner, the tear panel 80 will not fall into a beverage can (not shown) attached to the beverage can lid 72. The closure 10 is positioned on the rim 70 and is capable of moving or sliding along the rim 70 to move the closure 10 from the initial position. The body 12 of the closure 10 is positioned below the tab 74 with the left ear section 20 and the right ear section 26 being underneath the tab 74.

Figure 9:
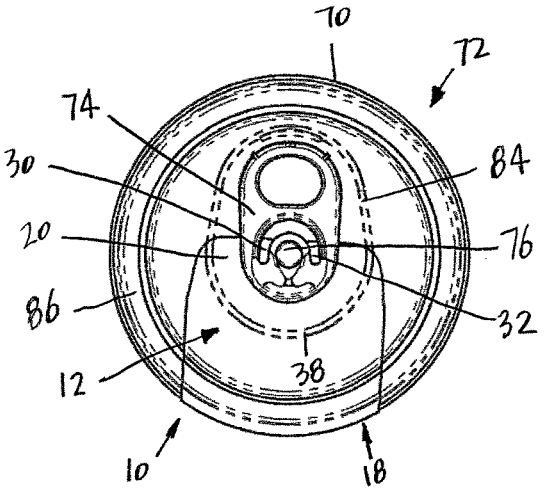
FIG. 9 is a top view of the closure for a beverage can lid constructed according to the present disclosure with the closure in a closed position and the beverage can lid opening or unopened.
Figure 8:
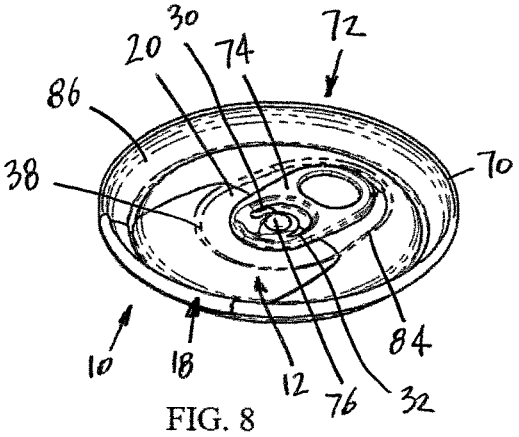
FIG. 8 is a perspective view of the closure for a beverage can lid constructed according to the present disclosure with the closure in a closed position and the beverage can lid opened or unopened.

Referring now to FIGS. 8 and 9, the closure 10 is shown in a closed position covering either the tear panel 80 (FIGS. 4 and 5) when the beverage can lid 72 (FIGS. 4 and 5) has not been opened or the opening 88 (FIGS. 6 and 7) when the beverage can lid 72 (FIGS. 6 and 7) has been opened. The closure 10 has been moved or rotated about the rivet 76 by use of the central rounded recess 24 (FIGS. 1 and 2) from the initial position to the closed position by sliding or moving the track portion 18 along the rim 70. The body 12 completely covers the tear panel 80 or the opening 88 and is below or beneath the tab 74. The step down section 38 also rides within the indented area 84 which ensures that the body 12 remains flat or tight against the beverage can lid 72. Due to the left tooth section 20 the hinge 82 (FIGS. 4, 5, 6, and 7) is also covered to prevent any leaking of fluid from the beverage can (not shown) when the closure 10 is in the closed position. The rib portions 30 and 32 are also used to hold the tab 74 in place. The rib portions 30 and 32 are further used to move the tab 74 so that the cover 10 can freely rotate or slide. As has been described above, the shape of the track portion 18 (FIGS. 1, 2, and 3) is similar to the shape of the rim 70 and the shape of the U-shaped portion 50, the arched segment 52, and the generally U-shaped portion 54, all of which are shown in FIG. 3, are formed to be similar to the shape of the surface 86. This allows the closure 10 to easily slide or ride along the rim 70.

The operation of the closure 10 may be as follows with reference to FIGS. 1-9. A beverage can body is filled with a beverage and the beverage can lid 72 is sealed to the beverage can body to form the rim 70 by a seaming operation to construct a beverage can. Once the beverage can is manufactured the closure 10 may be positioned on the rim 70 of the beverage can by inserting the front end 16 underneath the tab 74 and placing the track portion 18 over the rim 72. The closure 10 is then moved to the initial position. The tab 74 is lifted to rupture the tear panel 80 along the score line 78. The tear panel 80 is partially detached or separated from the beverage can lid 72 to form the opening 88 and any beverage inside the beverage can may be removed through the opening 88. When an individual wants to cover or seal the opening 88 the closure 10 is moved from the initial position to the closed position to fully cover the opening 88. When the individual wants to again drink from the beverage can the closure may be moved from the closed position to the initial position. The beverage can may be held, stored, or refrigerated without concern that the beverage will spill out of the beverage can or that the beverage will become stale or that the beverage will be contaminated. As is known, once the beverage from the beverage can has been consumed, the beverage can and the closure 10 may be recycled.

Figure 11:
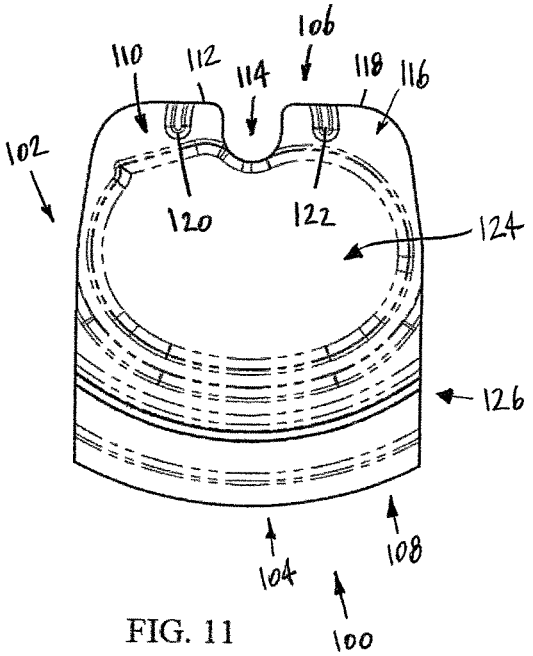
FIG. 11 is a top view of the closure for a beverage can lid shown in FIG. 10.
Figure 10:
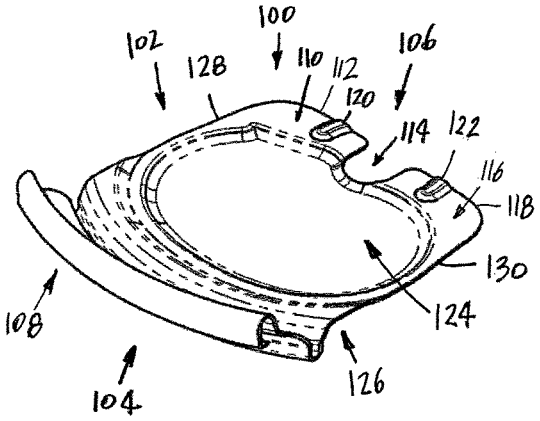
FIG. 10 is a perspective view of another embodiment of a closure for a beverage can lid constructed according to the present disclosure.

FIGS. 10 and 11 illustrated another embodiment of a closure for a beverage can lid 100 constructed according to the present disclosure. The closure 100 is shown to comprise a body 102 having a back end 104 and a front end 106. The back end 104 has a track portion 108 that is used to ride, slide, or move along a rim (not shown) of a beverage can lid (not shown). The front end 106 has a first or left tooth or ear section 110 having a left front edge 112, a central rounded recess or slot 114, and a second or right tooth or ear section 116 having a right front edge 118. The first section 110 has a left nub or rib portion 120 and the second portion 116 has a right nub or rib portion 122. The rib portions 120 and 122 are shorter than the central rounded recess 114. The body 102 also has an indented panel portion 124, a rear panel portion 126, a left edge 128, and a right edge 130. The indented panel portion 124 is adapted to fit within an opening, such as the opening 88 (FIGS. 6 and 7). The track portion 108 is curved or arcuate in shape and is adapted to fit around a rim (not shown).

Figure 12:
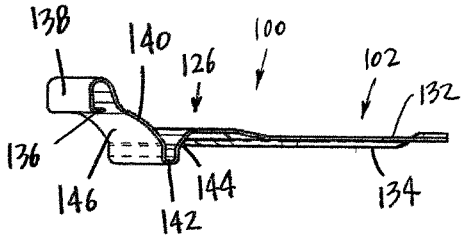
FIG. 12 is a side view of the closure for a beverage can lid shown in FIG. 10.

Referring now in particular to FIG. 12, a side perspective of the closure for a beverage can lid 100 constructed according to the present disclosure is shown. The closure 100 has the body 102 having a top surface 132 and a bottom surface 134. The bottom surface 134 is adapted to engage with or cover a beverage can lid (not shown). The track portion 108 has a lower lip portion 136 and a generally inverted U-shaped portion 138. The U-shaped portion 138 continues to an arched segment 140 and a generally U-shaped portion 142. The generally U-shaped portion 142 continues to an angled segment 144 and to the rear panel portion 126. The track portion 108, the arched segment 140, and the generally U-shaped portion 142 have a bottom surface 146 that is adapted to engage with or cover a rim (not shown) of a beverage can (not shown). The closure 100 is of unitary construction in that the body 102, the track portion 108, the arched segment 140, the generally U-shaped portion 142, and the angled segment 144 are formed from one piece of material.

With reference now to FIGS. 13 and 14 another embodiment of a closure for a beverage can lid 200 constructed according to the present disclosure is shown. The closure 200 comprises a body 202 having a back end 204 and a front end 206. The back end 204 has a track portion 208 that is used to ride, slide, or move along a rim (not shown) of a beverage can lid (not shown). The front end 206 has a first or left tooth or ear section 210 having a left front edge 212, a central rounded recess or slot 214, and a second or right tooth or ear section 216 having a right front edge 218. The first section 210 has a left nub or rib portion 220 and the second portion 216 has a right nub or rib portion 222. The rib portions 220 and 222 are shorter than the central rounded recess 214. The body 202 also has a flat front panel portion 224, a rear panel portion 226, a left edge 228, and a right edge 230. The flat front panel portion 224 is adapted to fit within an opening, such as the opening 88 (FIGS. 6 and 7). The track portion 208 is curved or arcuate in shape and is adapted to fit around a rim (not shown).

FIG. 15 depicts a side perspective of the closure for a beverage can lid 200 constructed according to the present disclosure. The closure 200 has the body 202 having a top surface 232 and a bottom surface 234. The bottom surface 234 is adapted to engage with or cover a beverage can lid (not shown). The track portion 208 has a lower lip portion 236 and a generally inverted U-shaped portion 238. The U-shaped portion 238 continues to an arched segment 240 and a generally U-shaped portion 242. The generally U-shaped portion 242 continues to an angled segment 244 and to the rear panel portion 226. The track portion 208, the arched segment 240, and the generally U-shaped portion 242 have a bottom surface 246 that is adapted to engage with or cover a rim (not shown) of a beverage can (not shown). The closure 200 is of unitary construction in that the body 202, the track portion 208, the arched segment 240, the generally U-shaped portion 242, and the angled segment 244 are formed from one piece of material.

Figure 16:
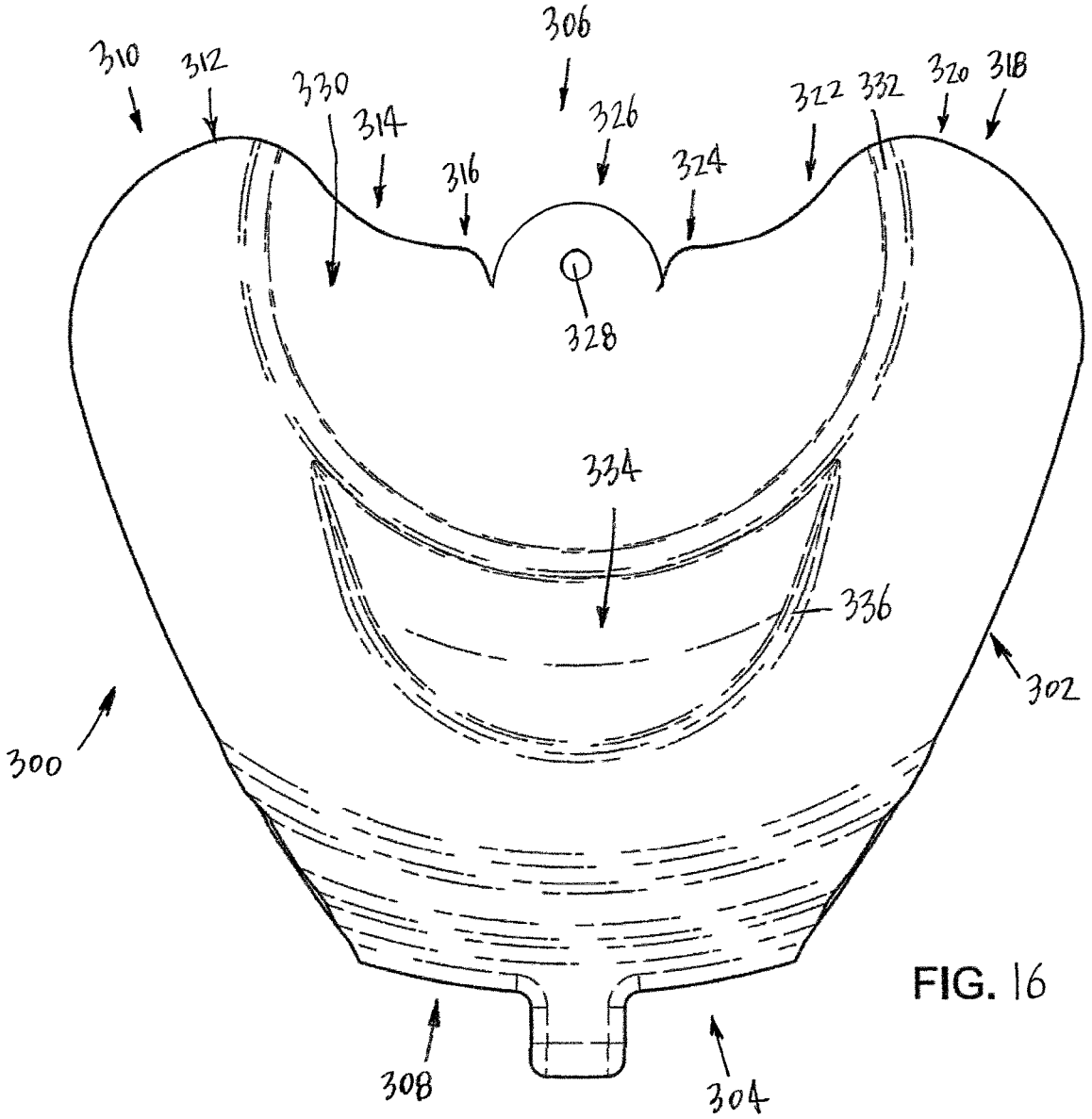
FIG. 16 is a top view of another embodiment of a closure for a beverage can lid constructed according to the present disclosure.

With particular reference now to FIG. 16, another embodiment of a cover or a closure for a beverage can 300 is illustrated. The closure 300 comprises a body 302 having a back end 304 and a front end 306. The back end 304 has a track portion 308 that is used to ride, slide, or move along a rim (not shown) of a beverage can lid (not shown). The front end 306 has a first or left tooth or ear section 310 having a first or left rounded section 312, a first or left indented portion 314, and a first or left lobe section 316. The front end 306 also has a second or right tooth or ear section 318 having a second or right rounded section 320, a second or right indented portion 322, and a second or right lobe section 324. A central rounded section 326 is formed or positioned between the first ear section 310 and the second ear section 318 and extends out from the body 302. The central rounded section 326 has a rivet opening 328 formed therein for receiving a rivet (not shown), as will be explained in detail further herein. The body 302 has a first central section 330 having a first step down section 332. The first step down section 332 is curved or arcuate in shape and spans from the first ear section 310 to the second ear section 318. The body 302 also has a second central section 334 having a second step down section 336. The second step down section 336 is also curved or arcuate in shape. The central sections 330 and 334 and the step down sections 332 and 336 are adapted to fit within various indentations formed in a beverage can lid (not shown), as will be described in further detail herein.

Figure 17:
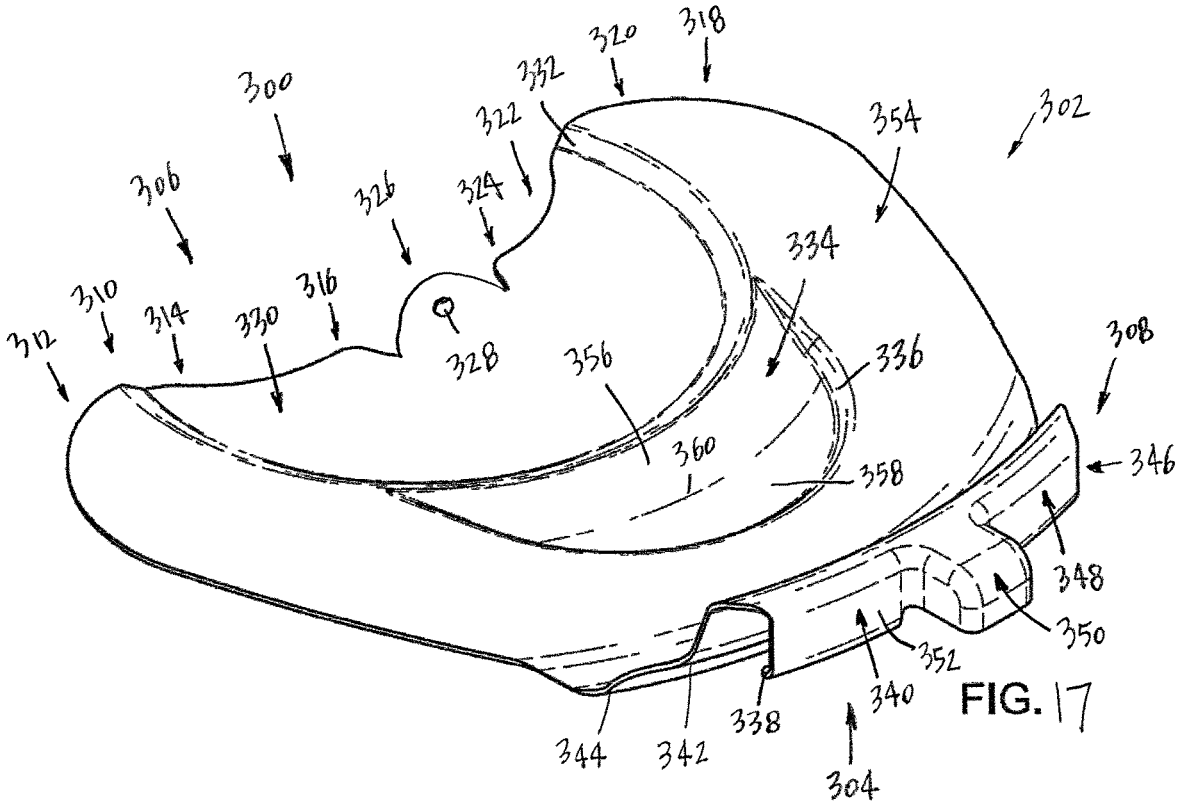
FIG. 17 is a side perspective view of the closure for a beverage can lid shown in FIG. 16.

FIG. 17 shows a side perspective view of the closure for a beverage can 300. The closure 300 has the body 302 having the back end 304 and the front end 306. The front end 306 has the first or left tooth or ear section 310 having the first or left rounded section 312, the first or left indented portion 314, and the first or left lobe section 316. The front end 306 also has the second or right tooth or ear section 318 having the second or right rounded section 320, the second or right indented portion 322, and the second or right lobe section 324. The central rounded section 326 is formed or positioned between the first ear section 310 and the second ear section 318 and has the rivet opening 328 formed therein. The body 302 has the first central section 330 having the first step down section 332. The body 302 also has the second central section 334 having the second step down section 336. The back end 304 has the track portion 308 that is used to ride, slide, or move along a rim (not shown) of a beverage can lid (not shown). The track portion 308 has a first or left lower lip portion 338 and a first or left generally inverted U-shaped track portion 340. The portion 340 continues to an arched segment 342 and a generally U-shaped portion 344. The track portion 308 also has a second or right lower lip portion 346 and a second or right generally inverted U-shaped track portion 348. The track portion 308 has a finger grab portion 350 positioned between the first generally U-shaped track portion 340 and the second generally inverted U-shaped track portion 348. The finger grab portion 350 extends out from the track portion 308. The finger grab portion 350 is used to facilitate movement of the closure 300. The track portion 308 is not as wide as the front end 306. This aids in reducing any friction when rotating or moving the closure 300. Although the finger grab portion 350 is shown it is contemplated that the finger grab portion 350 may be omitted and the first track portion 340 and the second track portion 348 may be a single track portion that has a surface 352 against which a finger may be pressed to move the closure 300. It is also possible that the finger grab portion 350 or the surface 352 may have a knurled feature that provides a fiction surface against which a finger may be placed to move the closure 300. The body 302 also has an outer arcuate section 354 formed between the track portion 308 and the first central section 330 and the second central section 334. The second central section 334 also has a front section 356 and a rear section 358. The front section 356 is higher than the rear section 358. A line 360 is shown marking the change between the higher front section 356 and the lower rear section 358. The reason for the differences in height will be explained more fully herein. The closure 300 is of unitary construction in that the body 302, the track portion 308, the generally U-shaped portions 340 and 348, the arched segment 342, the generally U-shaped portion 344, and the finger grab portion 350 are formed from one piece of material.

Figure 18:
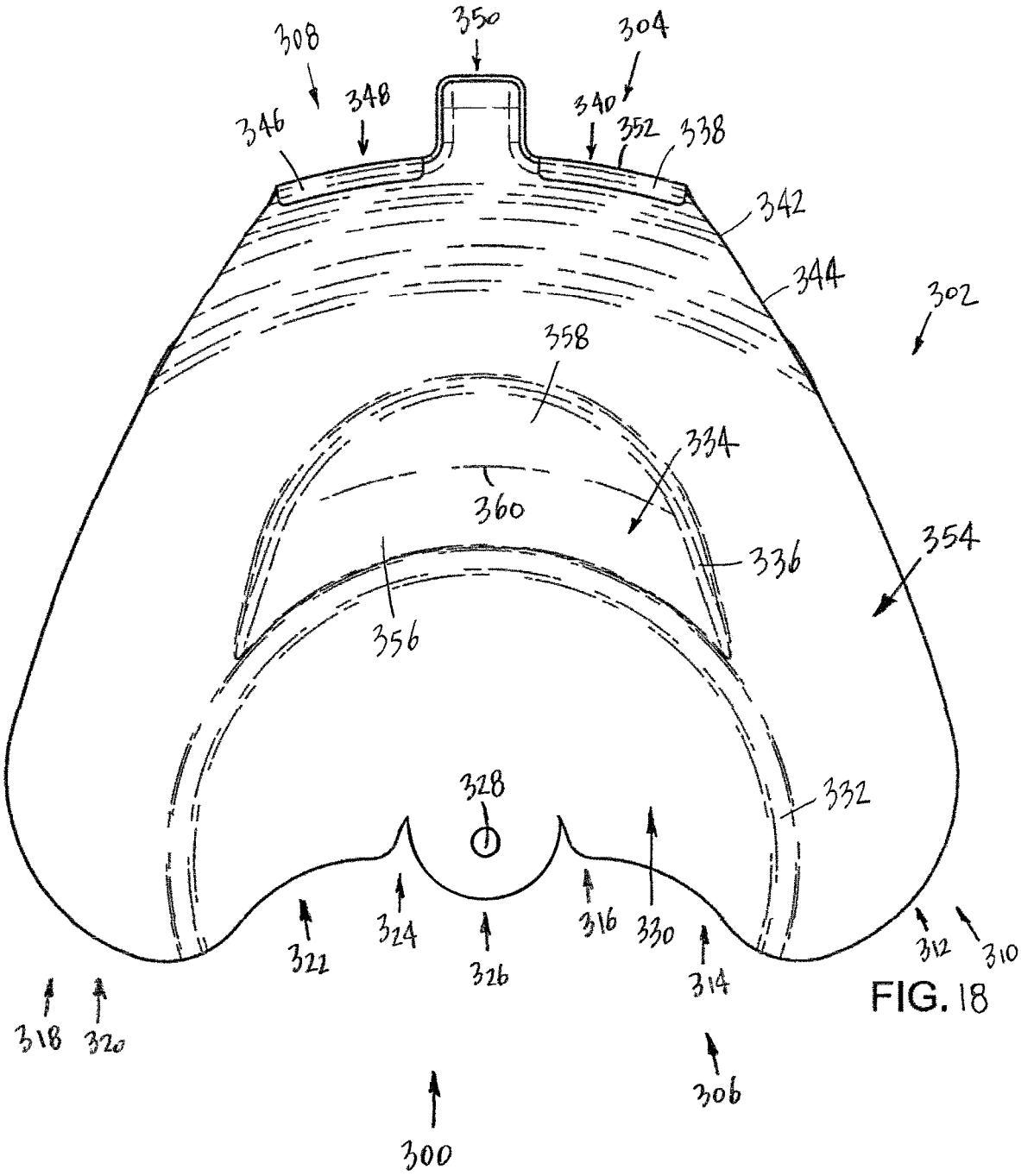
FIG. 18 is a bottom view of the closure for a beverage can lid shown in FIG. 16.

Referring now to FIG. 18, a bottom view of the closure 300 is depicted. The closure 300 shown to comprise the body 302 having the back end 304 and the front end 306. The front end 306 has the first or left tooth or ear section 310 having the first or left rounded section 312, the first or left indented portion 314, and the first or left lobe section 316. The front end 306 also has the second or right tooth or ear section 318 having the second or right rounded section 320, the second or right indented portion 322, and the second or right lobe section 324. The central rounded section 326 is formed or positioned between the first ear section 310 and the second ear section 318 and has the rivet opening 328 formed therein. The body 302 has the first central section 330 having the first step down section 332. The body 302 also has the second central section 334 having the second step down section 336. The back end 304 has the track portion 308 that is used to ride, slide, or move along a rim (not shown) of a beverage can lid (not shown). The track portion 308 has the first or left lower lip portion 338 and the first or left generally inverted U-shaped track portion 340. The portion 340 continues to the arched segment 342 and the generally U-shaped portion 344. The track portion 308 also has the second or right lower lip portion 346 and the second or right generally inverted U-shaped track portion 348. The track portion 308 has the finger grab portion 350 positioned between the first generally U-shaped track portion 340 and the second generally inverted U-shaped track portion 348. The surface 352 is also shown. The body 302 also has the outer arcuate section 354 formed between the track portion 308 and the first central section 330 and the second central section 334. The second central section 334 has the front section 356, the rear section 358, and the line 360 that illustrates the transition from the higher front section 356 to the lower rear section 358.

Figure 19:
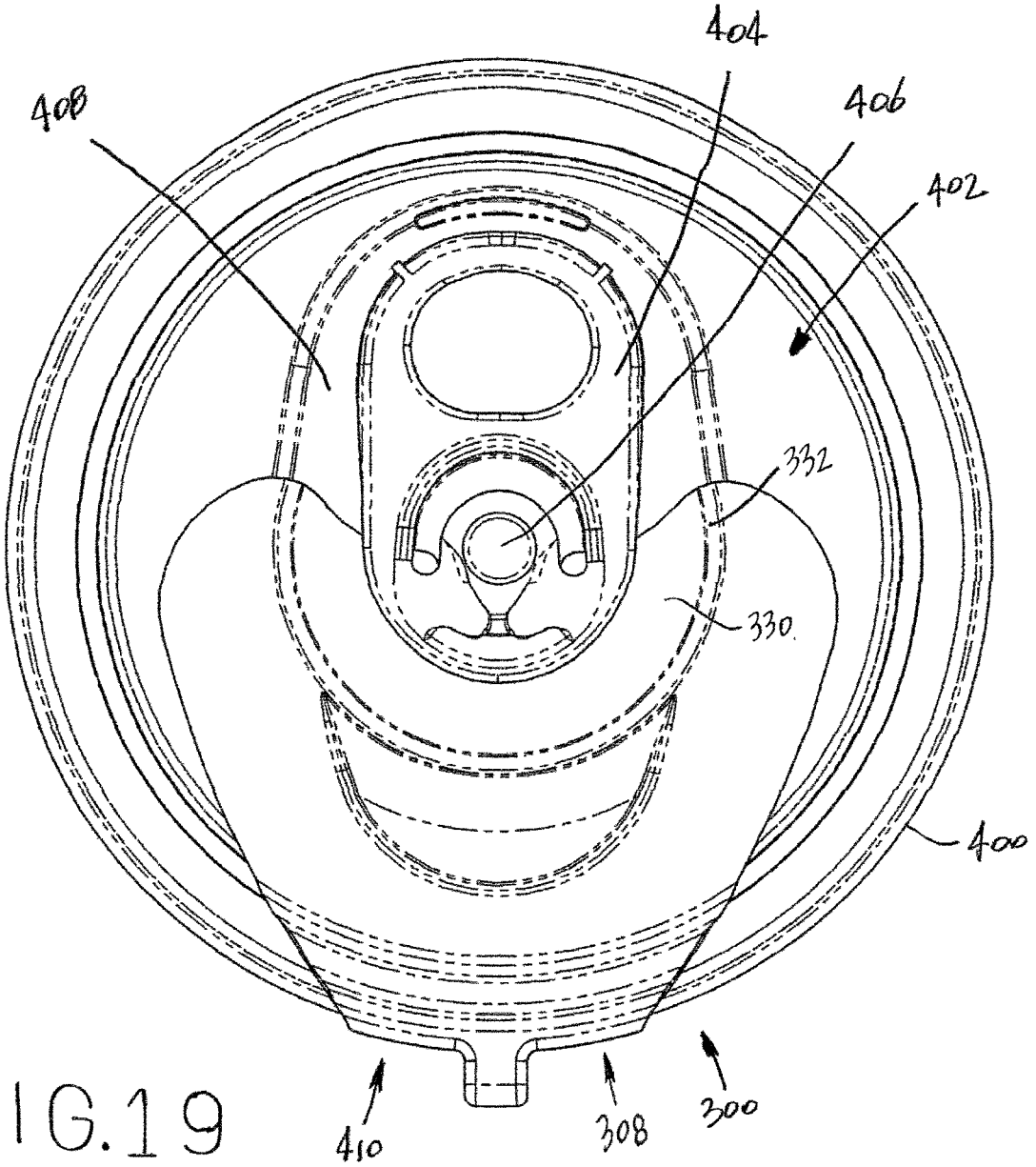
FIG. 19 is a top view of the closure for a beverage can lid shown in FIG. 16 with the closure in an initial position and the beverage can lid unopened.

FIG. 19 illustrates the closure 300 being positioned on a rim 400 of a beverage can lid 402. The beverage can lid 402 has a tab 404 that is staked to a rivet 406. The closure 300 is also staked to the rivet 406 by use of the rivet opening 328 formed in the central rounded section 326. The beverage can lid 402 also has an indented area 408 with such indented area 408 being in the shape of a teardrop or a figure eight. The closure 300 is depicted in an initial orientation at the 6 o'clock position 410. The track portion 308 is snapped or secured in place to the rim 400. The track portion 308 facilitates movement of the closure 300 around the rim 400. As should be appreciated the central rounded section 326 and the rivet opening 328 are configured to rotate about the rivet 406. The first central section 330 having the first step down section 332 are also designed to fit within the indented area 408. This particular configuration assists in allowing the closure 300 to rotate adjacent to the lid 402 while keeping the closure 300 close to the lid 402 and the indented area 408.

Figure 20:
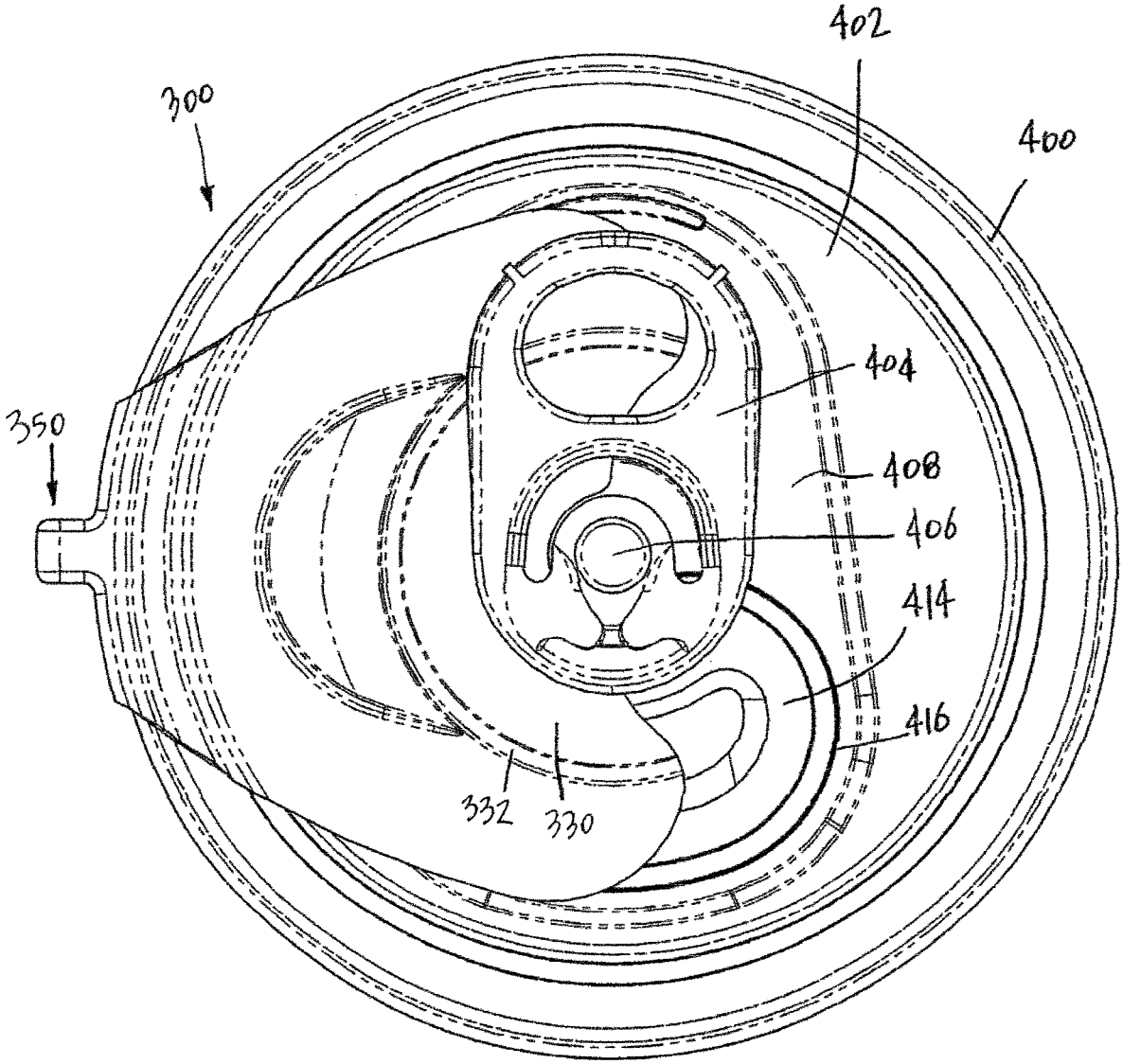
FIG. 20 is a top view of the closure for a beverage can lid shown in FIG. 16 with the closure in a 9 o'clock position and the beverage can lid unopened.

With particular reference now to FIG. 20, the closure 300 is illustrated being moved or rotated to a 9 o'clock position 412. The lid 402 has the rim 400, the tab 404, the rivet 406, and the indented area 408. With the closure 300 moved to the 9 o'clock position 412 the lid 402 is shown to also include a tear panel 414 that is adapted to be ruptured along a score line 416. The first central section 330 having the first step down section 332 is also shown fitting within the indented area 408 and being able to rotate within the indented area 408. As can be appreciated, the finger grab portion 350 may be used to grasp the closure 300 to rotate the closure 300 about the rim 400 and the rivet 406.

Figure 21:
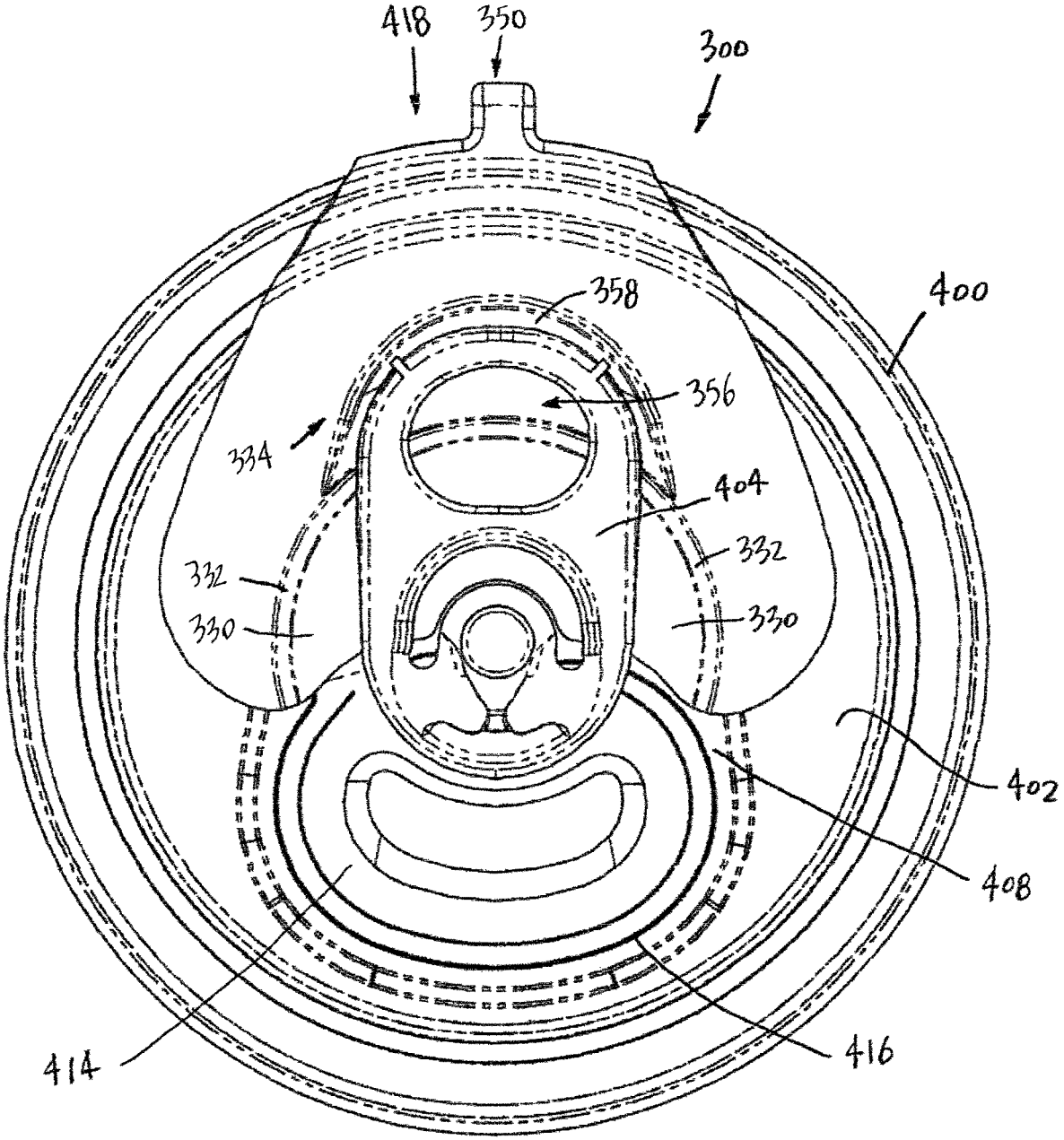
FIG. 21 is a top view of the closure for a beverage can lid shown in FIG. 16 with the closure in a 12 o'clock position and the beverage can lid unopened.

FIG. 21 shows the closure 300 being positioned at a 12 o'clock position 418 on the rim 400 of the beverage can lid 402. The tab 404 is shown being lifted due to the configuration of the front section 356 of the second central section 334 being higher than the rear section 358. In essence, the front section 356 lifts the tab 404 up and with the rear section 358 being lower than the front section 356 this provides the ability to place a finger underneath the tab 404 to easily grasp the tab 404 to lift the tab 404 up to open the lid 402. The tab 404 is further lifted to press against the tear panel 414 to rupture the tear panel 414 along the score line 416 to open the lid 402. Again, having the front section 356 higher than the rear section 358 props the tab 404 up and away from the lid 402 to easily open the lid 402. The second central section 334 also serves to center or align the tab 404 in place to be able to easily open the lid 402. The first central section 330 having the first step down section 332 is also shown fitting within the indented area 408 and being able to rotate within the indented area 408. The finger grab portion 350 may be used to grasp the closure 300 to rotate the closure 300 about the rim 400 to the 12 o'clock position 418.

In operation, the closure 300 is staked to the rivet 406 of the beverage can lid 402. Although not shown, the beverage can lid 402 is sealed to a beverage can containing a beverage. The closure 300 is initially positioned in the 6 o'clock position 410, as is shown in FIG. 19. In this position 410 the cover 300 protects the tear panel 414 from accidentally opening during transportation or storage. This also aids in keeping the tear panel 414 of the lid 402 clean from debris. Once the lid 402 needs to be opened the closure 300 is rotated about the rim 400 and the rivet 406 to the 12 o'clock position 418. In the 12 o'clock position 418 the cover 300 completely uncovers the tear panel 414 and the tab 404 is easy to grasp. The tab 404 is lifted to press into the tear panel 414 to open the beverage can lid 402 by rupturing the tear panel 414 along the score line 416. Once opened, the contents of a beverage can (not shown) may be removed through an opening (not shown) formed by partially detaching the tear panel 414. In the 12 o'clock position 418 the closure 300 does not prevent the tab 404 from being lifted or employed. Since the closure 300 is positioned on the rim 400 the closure 300 is capable of moving or sliding along the rim 400 to move the closure 300 back to the 6 o'clock position 410. Once in the position 410, the closure 300 is used to cover the opening formed in the lid 402. The closure 300 prevents any beverage or liquid within the beverage can from leaking out. The first tooth or ear section 310 and the second tooth or ear section 318 assists in preventing any leaking of the beverage from the beverage can. As should be appreciated, the shape of the track portion 308 is similar to the shape of the rim 400. This allows the closure 300 to easily slide along the rim 400 reducing or eliminating any rotational friction.

Figure 22:
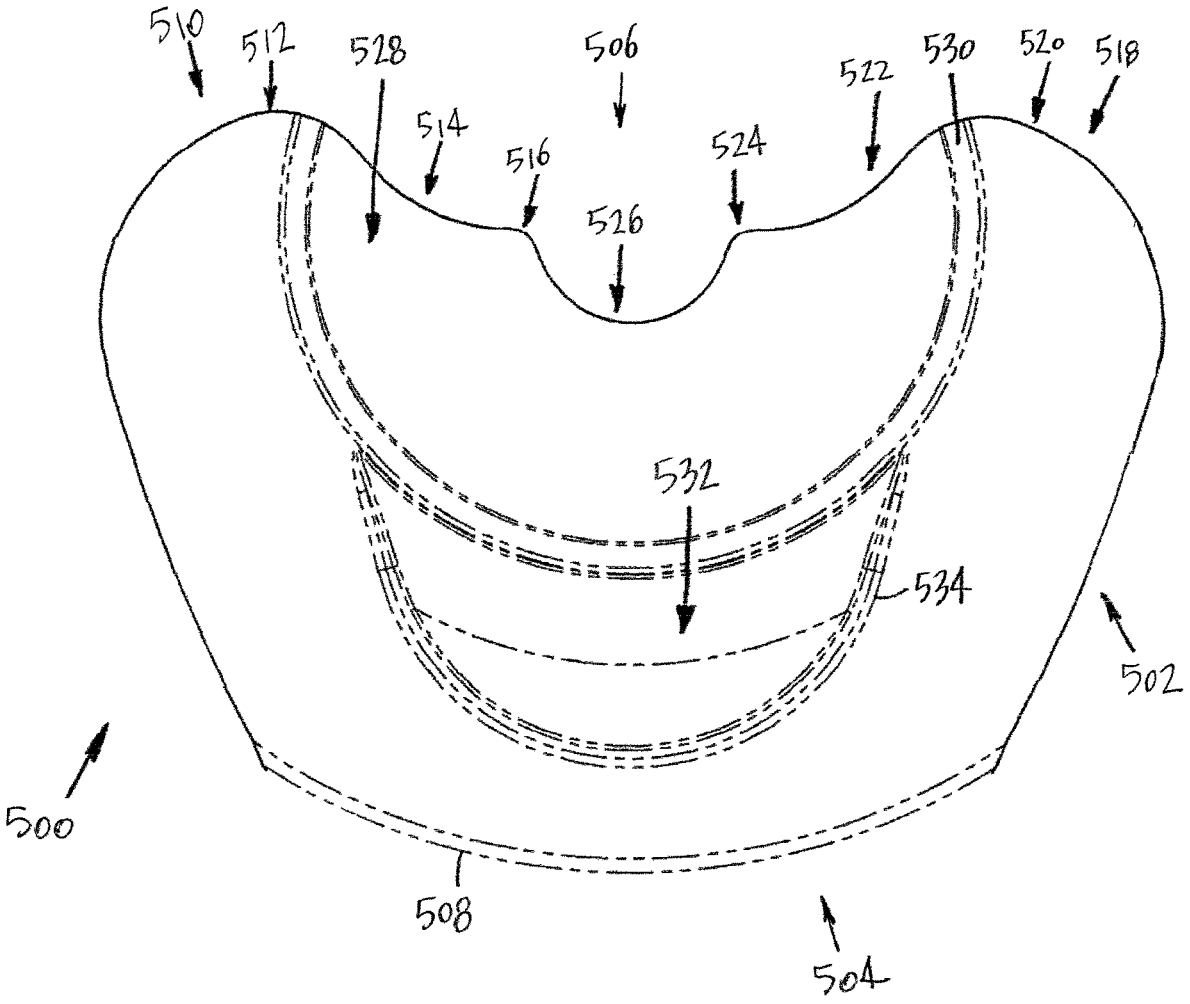
FIG. 22 is a top view of another embodiment of a closure for a beverage can lid constructed according to the present disclosure.

Referring now in particular to FIG. 22, another embodiment of a cover or a closure for a beverage can 500 is illustrated. The closure 500 comprises a body 502 having a back end 504 and a front end 506. The back end 504 has a curved or arcuate edge 508 that is used to ride, slide, or move along a rim (not shown) of a beverage can lid (not shown). The curved edge 508 is held in place against or underneath the rim. The front end 506 has a first or left tooth or ear section 510 having a first or left rounded section 512, a first or left indented portion 514, and a first or left lobe section 516. The front end 506 also has a second or right tooth or ear section 518 having a second or right rounded section 520, a second or right indented portion 522, and a second or right lobe section 524. A central rounded recess or slot 526 is formed or positioned between the first ear section 510 and the second ear section 518. The body 502 has a first central section 528 having a first step down section 530. The first step down section 530 is curved or arcuate in shape and spans from the first ear section 510 to the second ear section 518. The body 502 also has a second central section 532 having a second step down section 534. The second step down section 534 is also curved or arcuate in shape. The central sections 528 and 532 and the step down sections 530 and 534 are adapted to fit within various indentations formed in a beverage can lid (not shown), as will be described in further detail herein.

Figure 23:
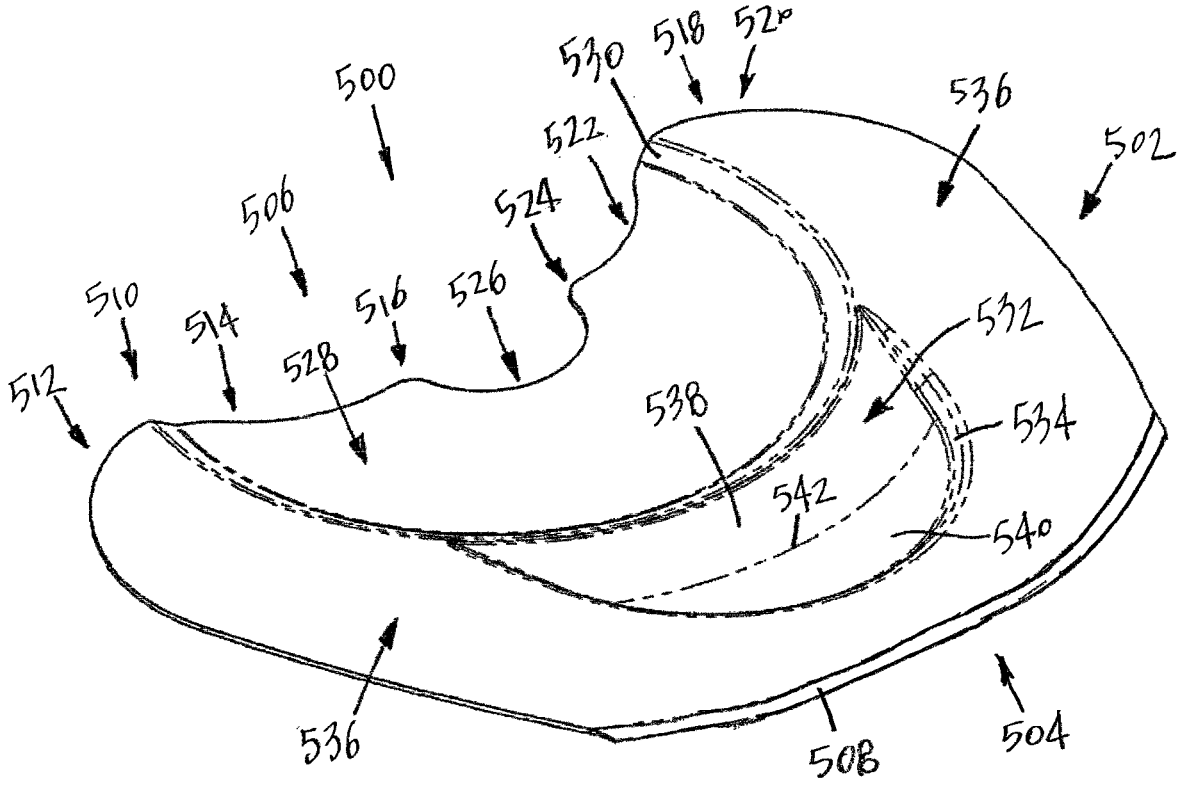
FIG. 23 is a side perspective view of the closure for a beverage can lid shown in FIG. 22.

FIG. 23 shows a side perspective view of the closure for a beverage can 500. The closure 500 has the body 502 having the back end 504 and the front end 506. The front end 506 has the first or left tooth or ear section 510 having the first or left rounded section 512, the first or left indented portion 514, and the first or left lobe section 516. The front end 506 also has the second or right tooth or ear section 518 having the second or right rounded section 520, the second or right indented portion 522, and the second or right lobe section 524. The central rounded recess or slot 526 is formed or positioned between the first ear section 510 and the second ear section 518. The body 502 has the first central section 528 having the first step down section 530. The body 502 also has the second central section 532 having the second step down section 534. The body 502 also has an outer arcuate section 536 formed between the curved edge 508 and the first central section 528 and the second central section 532. The second central section 532 also has a front section 538 and a rear section 540. The front section 538 is higher than the rear section 540. A line 542 is shown marking the change between the higher front section 538 and the lower rear section 540. The reason for the differences in height will be explained more fully herein. The closure 500 may be formed from one piece of material, such as aluminum.

Figure 24:
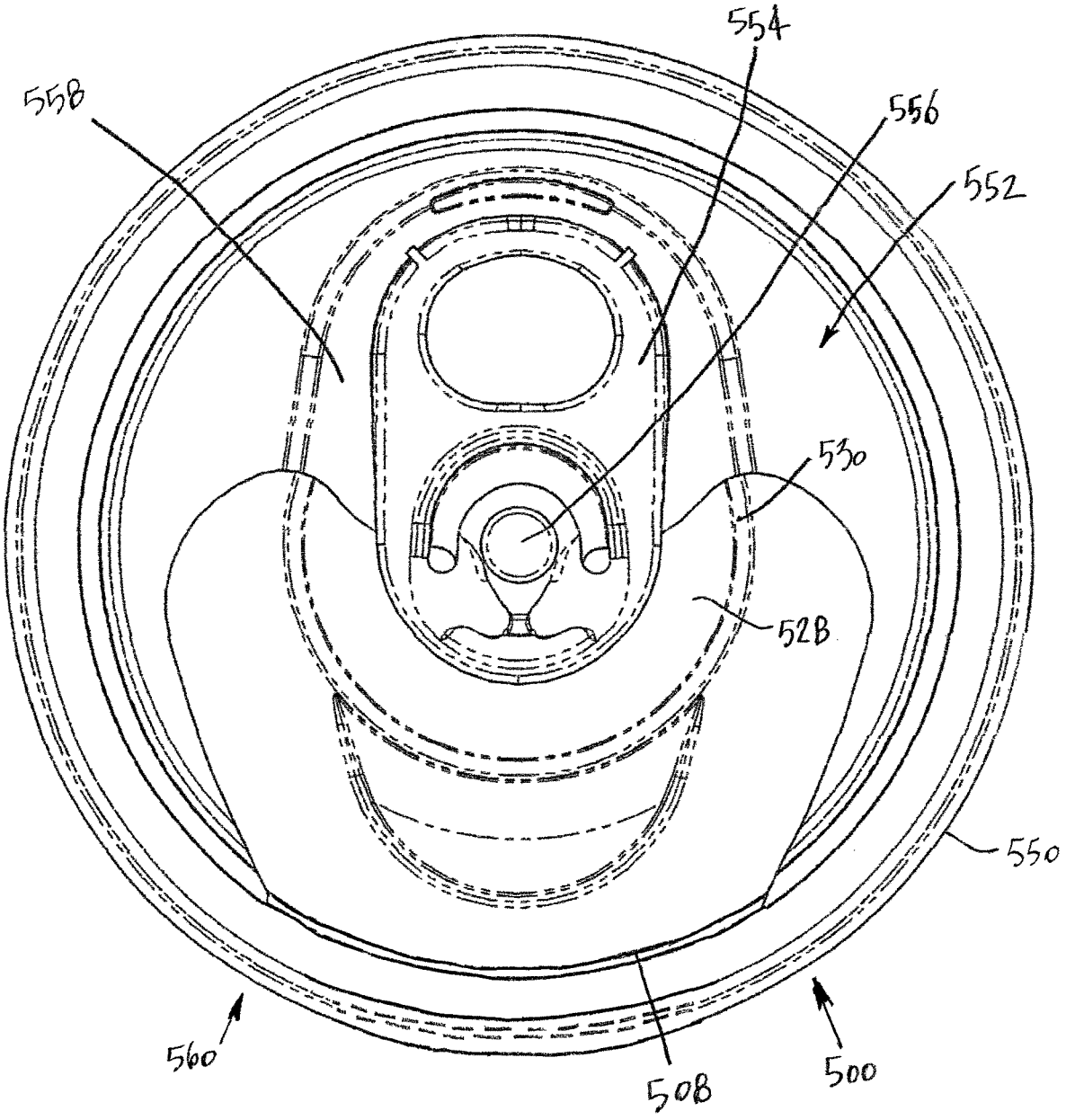
FIG. 24 is a top view of the closure for a beverage can lid shown in FIG. 22 with the closure in an initial position and the beverage can lid unopened.

FIG. 24 illustrates the closure 500 being positioned on a rim 550 of a beverage can lid 552. The beverage can lid 552 has a tab 554 that is staked to a rivet 556. The beverage can lid 552 also has an indented area 558 with such indented area 558 being in the shape of a teardrop or a figure eight. The closure 500 is depicted in an initial orientation at the 6 o'clock position 560. The curved edge 508 is snapped or secured in place into or against or beneath the rim 550. The curved edge 508 facilitates movement of the closure 500 around the rim 550. Although hidden in this particular view below the tab 554, it should be appreciated that the central rounded recess or slot 526 (FIG. 22) is configured to rotate about the rivet 556. The slot 526 has a larger circumference than the rivet 556 to allow the closure 500 to rotate about the rivet 556 without contacting the rivet 556. The first central section 528 having the first step down section 530 are also designed to fit within the indented area 558. This particular configuration assists in allowing the closure 500 to rotate adjacent to the lid 552 while keeping the closure 500 close to the lid 552 and the indented area 558.

Figure 25:
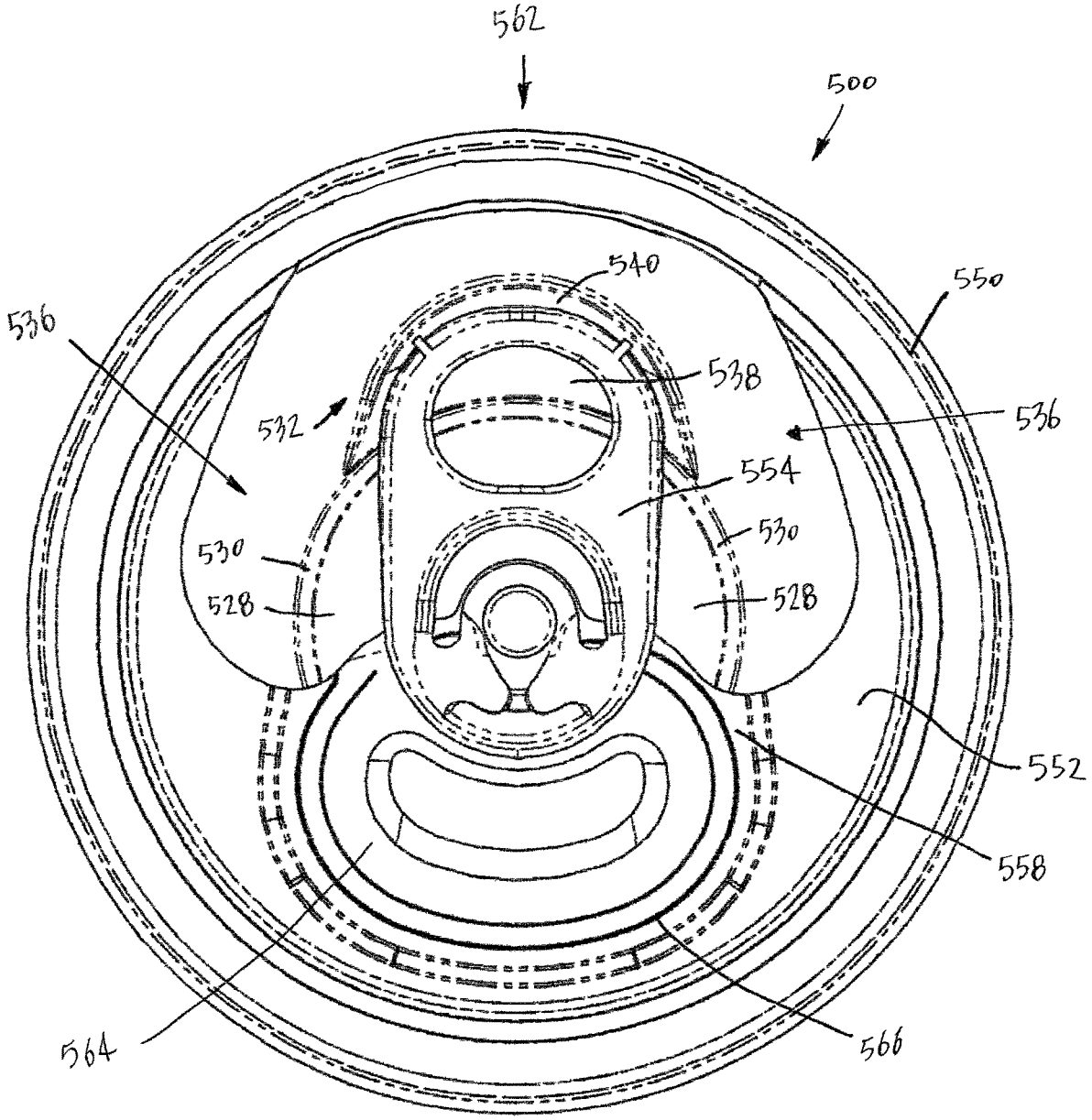
FIG. 25 is a top view of the closure for a beverage can lid shown in FIG. 22 with the closure in a 12 o'clock position and the beverage can lid unopened.

With reference now to FIG. 25, the closure 500 is depicted being positioned at a 12 o'clock position 562 on the rim 550 of the beverage can lid 552. The tab 554 is shown being lifted due to the configuration of the front section 538 of the second central section 532 being higher than the rear section 540. In essence, the front section 538 lifts the tab 554 up and with the rear section 540 being lower than the front section 538 this provides the ability to place a finger underneath the tab 554 to easily grasp the tab 554 to lift the tab 554 up to open the lid 552. The tab 554 is further lifted to press against a tear panel 564 to rupture the tear panel 564 along a score line 566 to open the lid 552. Again, having the front section 538 higher than the rear section 540 props the tab 554 up and away from the lid 552 to easily open the lid 552. The second central section 532 also serves to center or align the tab 554 in place to be able to easily open the lid 552. The first central section 528 having the first step down section 530 is also shown fitting within the indented area 558 and being able to rotate within the indented area 558. The outer arcuate section 536 may be used to rotate the closure 500 about the rim 550 between the 6 o'clock position 560 (FIG. 24) and the 12 o'clock position 562.

In operation, the closure 500 is placed on the rim 550 of the beverage can lid 552. Although not shown, the beverage can lid 552 is sealed to a beverage can containing a beverage. The closure 500 is initially positioned in the 6 o'clock position 560, as is shown in FIG. 24. In the 6 o'clock position 560 the cover 500 protects the tear panel 564 from accidentally opening during transportation or storage. This also aids in keeping the tear panel 564 of the lid 552 clean from debris. Once the lid 552 needs to be opened the closure 500 is rotated about the rim 550 to the 12 o'clock position 562. In the 12 o'clock position 562 the cover 500 completely uncovers the tear panel 564 and the tab 554 is easy to grasp. The tab 554 is lifted to press into the tear panel 564 to open the beverage can lid 552 by rupturing the tear panel 564 along the score line 566. Once opened, the contents of a beverage can (not shown) may be removed through an opening (not shown) formed by partially detaching the tear panel 564. In the 12 o'clock position 562 the closure 500 does not prevent the tab 554 from being lifted or employed. Since the closure 500 is in frictional engagement with the rim 550 the closure 500 is capable of moving, rotating, or sliding along or against the rim 550 to move the closure 500 back to the 6 o'clock position 560. Once in the 6 o'clock position 560, the closure 500 is used to cover the opening formed in the lid 552. The closure 500 prevents any beverage or liquid within the beverage can from leaking out and prevents any debris or foreign matter from entering into the beverage can.

Figure 26:
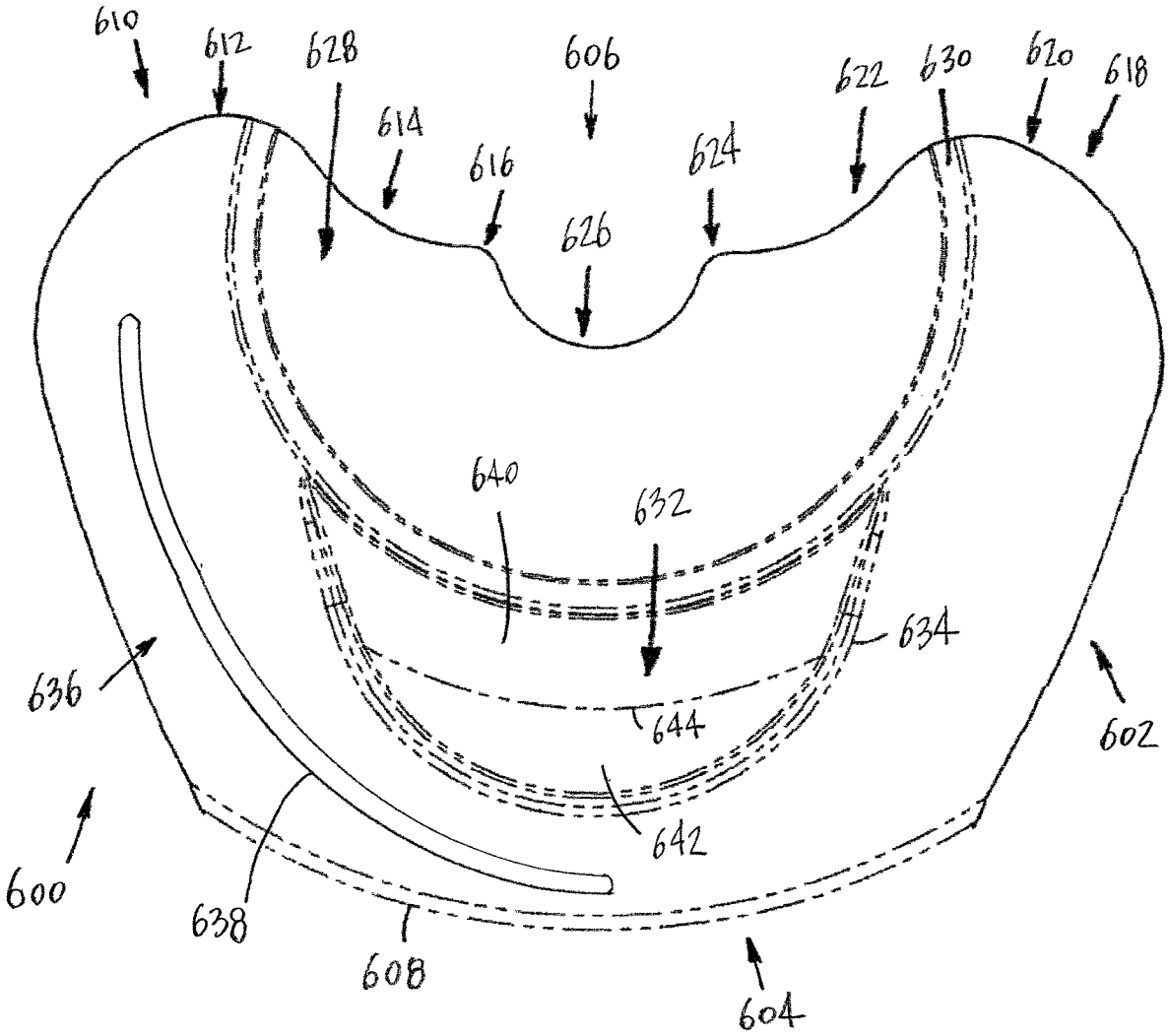
FIG. 26 is a top view of another embodiment of a closure for a beverage can lid constructed according to the present disclosure.

FIG. 26 illustrates another embodiment of a cover or a closure for a beverage can 600. The closure 600 comprises a body 602 having a back end 604 and a front end 606. The back end 604 has a curved or arcuate edge 608 that is used to ride, slide, or move along a rim (not shown) of a beverage can lid (not shown). The curved edge 608 is held in place against or underneath the rim. The front end 606 has a first or left tooth or ear section 610 having a first or left rounded section 612, a first or left indented portion 614, and a first or left lobe section 616. The front end 606 also has a second or right tooth or ear section 618 having a second or right rounded section 620, a second or right indented portion 622, and a second or right lobe section 624. A central rounded recess or slot 626 is formed or positioned between the first ear section 610 and the second ear section 618. The body 602 has a first central section 628 having a first step down section 630. The first step down section 630 is curved or arcuate in shape and spans from the first ear section 610 to the second ear section 618. The body 602 also has a second central section 632 having a second step down section 634. The second step down section 634 is also curved or arcuate in shape. The central sections 628 and 632 and the step down sections 630 and 634 are adapted to fit within various indentations formed in a beverage can lid (not shown), as will be described in further detail herein. The body 602 also has an outer arcuate section 636 formed between the curved edge 608 and the first central section 628 and the second central section 632. The outer arcuate section 636 has a slot 638 formed therein. The second central section 632 also has a front section 640 and a rear section 642. The front section 640 is higher than the rear section 642. A line 644 is shown marking the change between the higher front section 640 and the lower rear section 642. The reason for the differences in height will be explained more fully herein. The closure 600 may be formed from one piece of material, such as aluminum.

Figure 27:
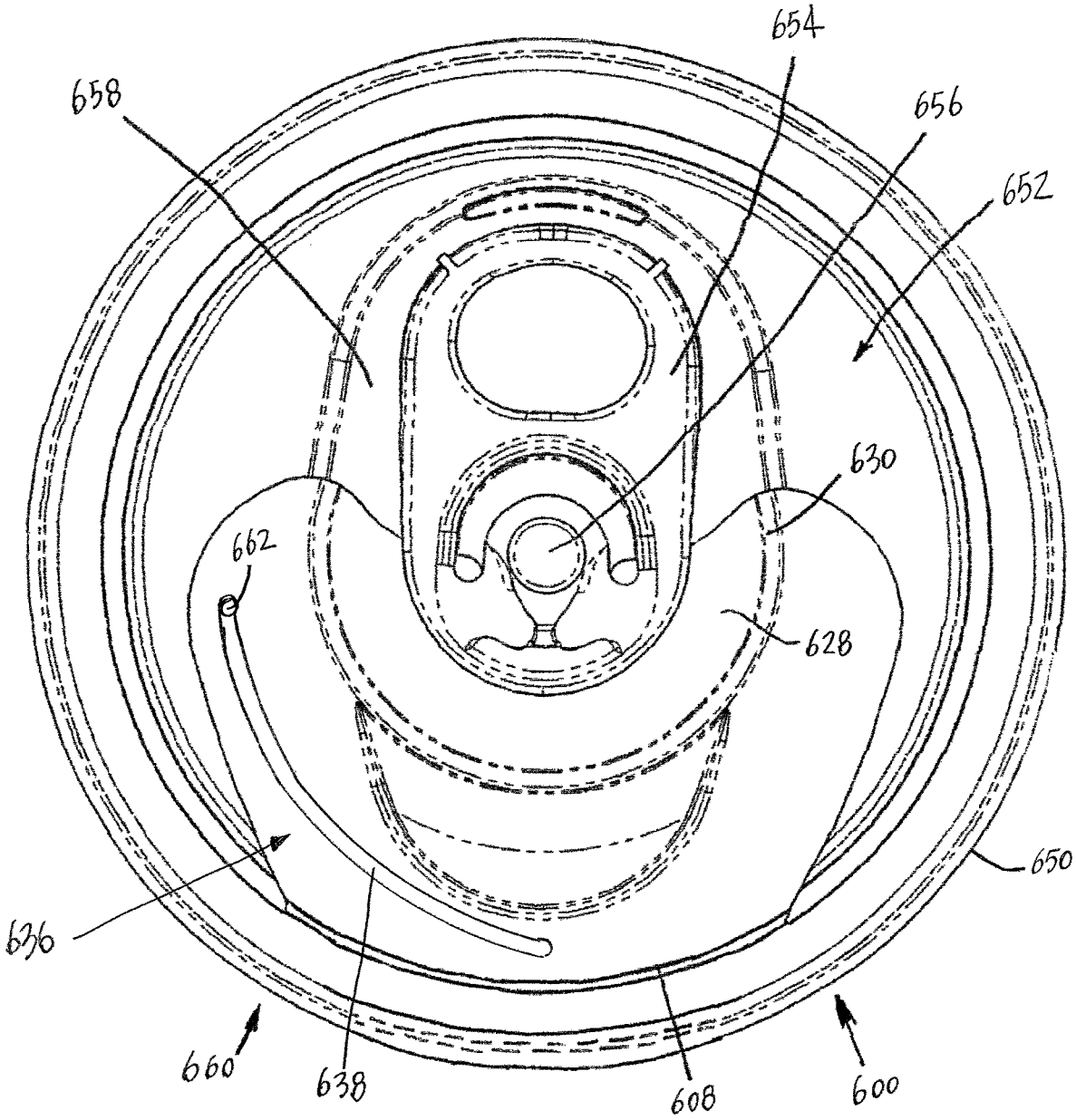
FIG. 27 is a top view of the closure for a beverage can lid shown in FIG. 26 with the closure in an initial position and the beverage can lid unopened.

With reference now to FIG. 27, the closure 600 is depicted being positioned on a rim 650 of a beverage can lid 652. The beverage can lid 652 has a tab 654 that is staked to a first rivet 656. The beverage can lid 652 also has an indented area 658 with such indented area 658 being in the shape of a teardrop or a figure eight. The closure 600 is depicted in an initial orientation at a 6 o'clock position 660. The curved edge 608 is snapped or secured in place into or against or beneath the rim 650. The curved edge 608 facilitates movement of the closure 600 around the rim 650. Although hidden in this particular view below the tab 654, it should be appreciated that the central rounded recess or slot 626 (FIG. 26) is configured to rotate about the first rivet 656. The slot 626 has a larger circumference than the first rivet 656 to allow the closure 600 to rotate about the first rivet 656 without contacting the first rivet 656. The first central section 628 having the first step down section 630 are also designed to fit within the indented area 658. This particular configuration assists in allowing the closure 600 to rotate adjacent to the lid 652 while keeping the closure 600 close to the lid 652 and the indented area 658. The lid 652 also has a second rivet 662 which captures the slot 638 formed in the outer arcuate section 636. The closure 600 is capable of rotating about the second rivet 662 through the use of the slot 638.

Figure 28:
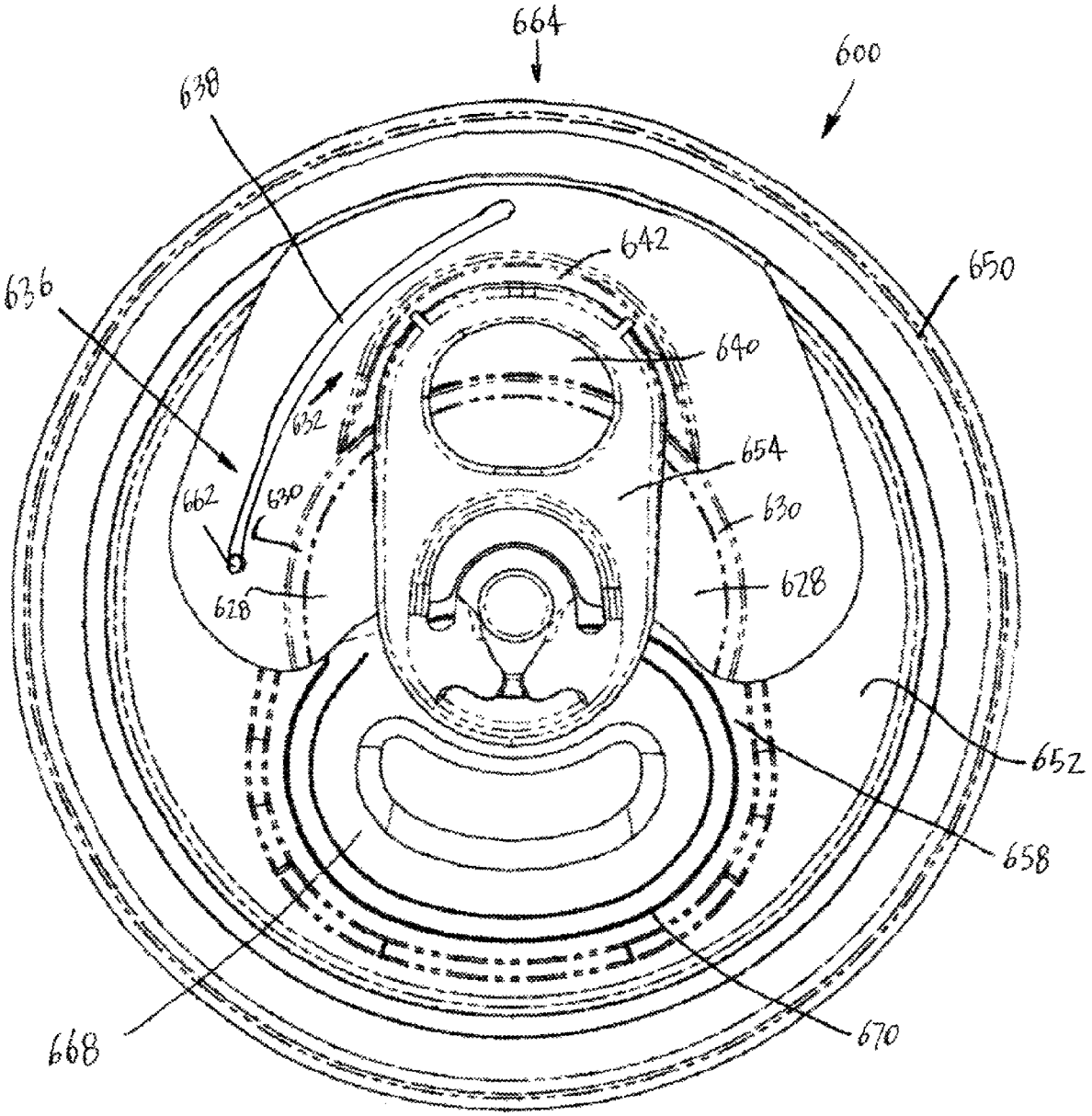
FIG. 28 is a top view of the closure for a beverage can lid shown in FIG. 26 with the closure in a 12 o'clock position and the beverage can lid unopened.

FIG. 28 shows the closure 600 being positioned at a 12 o'clock position 664 on the rim 650 of the beverage can lid 652. The tab 654 is shown being lifted due to the configuration of the front section 640 of the second central section 632 being higher than the rear section 642. In essence, the front section 640 lifts the tab 654 up and with the rear section 642 being lower than the front section 640 this provides the ability to place a finger underneath the tab 654 to easily grasp the tab 654 to lift the tab 654 up to open the lid 652. The tab 654 is further lifted to press against a tear panel 668 to rupture the tear panel 668 along a score line 670 to open the lid 652. Again, having the front section 640 higher than the rear section 642 props the tab 654 up and away from the lid 652 to easily open the lid 652. The second central section 632 also serves to center or align the tab 654 in place to be able to easily open the lid 652. The first central section 628 having the first step down section 630 is also shown fitting within the indented area 658 and being able to rotate within the indented area 658. The outer arcuate section 636 may be used to rotate the closure 600 about the rim 650 between the 6 o'clock position 660 (FIG. 27) and the 12 o'clock position 664. The slot 638 also captures the second rivet 662 and allows the closure 600 to rotate or slide around the second rivet 662.

In operation, the closure 600 is placed on the rim 650 of the beverage can lid 652. Although not shown, the beverage can lid 652 is sealed to a beverage can containing a beverage. The closure 600 is initially positioned in the 6 o'clock position 660, as is shown in FIG. 27. In the 6 o'clock position 660 the cover 600 protects the tear panel 668 from accidentally opening during transportation or storage. This also aids in keeping the tear panel 668 of the lid 652 clean from debris. Once the lid 652 needs to be opened the closure 600 is rotated about the rim 650 and the second rivet 662 to the 12 o'clock position 664. In the 12 o'clock position 664 the cover 600 completely uncovers the tear panel 668 and the tab 654 is easy to grasp. The tab 654 is lifted to press into the tear panel 668 to open the beverage can lid 652 by rupturing the tear panel 668 along the score line 670. Once opened, the contents of a beverage can (not shown) may be removed through an opening (not shown) formed by partially detaching the tear panel 668. In the 12 o'clock position 664 the closure 600 does not prevent the tab 654 from being lifted or employed. Since the closure 600 is held against the lid 652 by use of the slot 638 and the second rivet 662 the closure 600 is capable of moving, rotating, or sliding to move the closure 600 back to the 6 o'clock position 660. Once in the 6 o'clock position 660, the closure 600 is used to cover the opening formed in the lid 652. The closure 600 prevents any beverage or liquid within the beverage can from leaking out and prevents any debris or foreign matter from entering into the beverage can.

Figure 29:
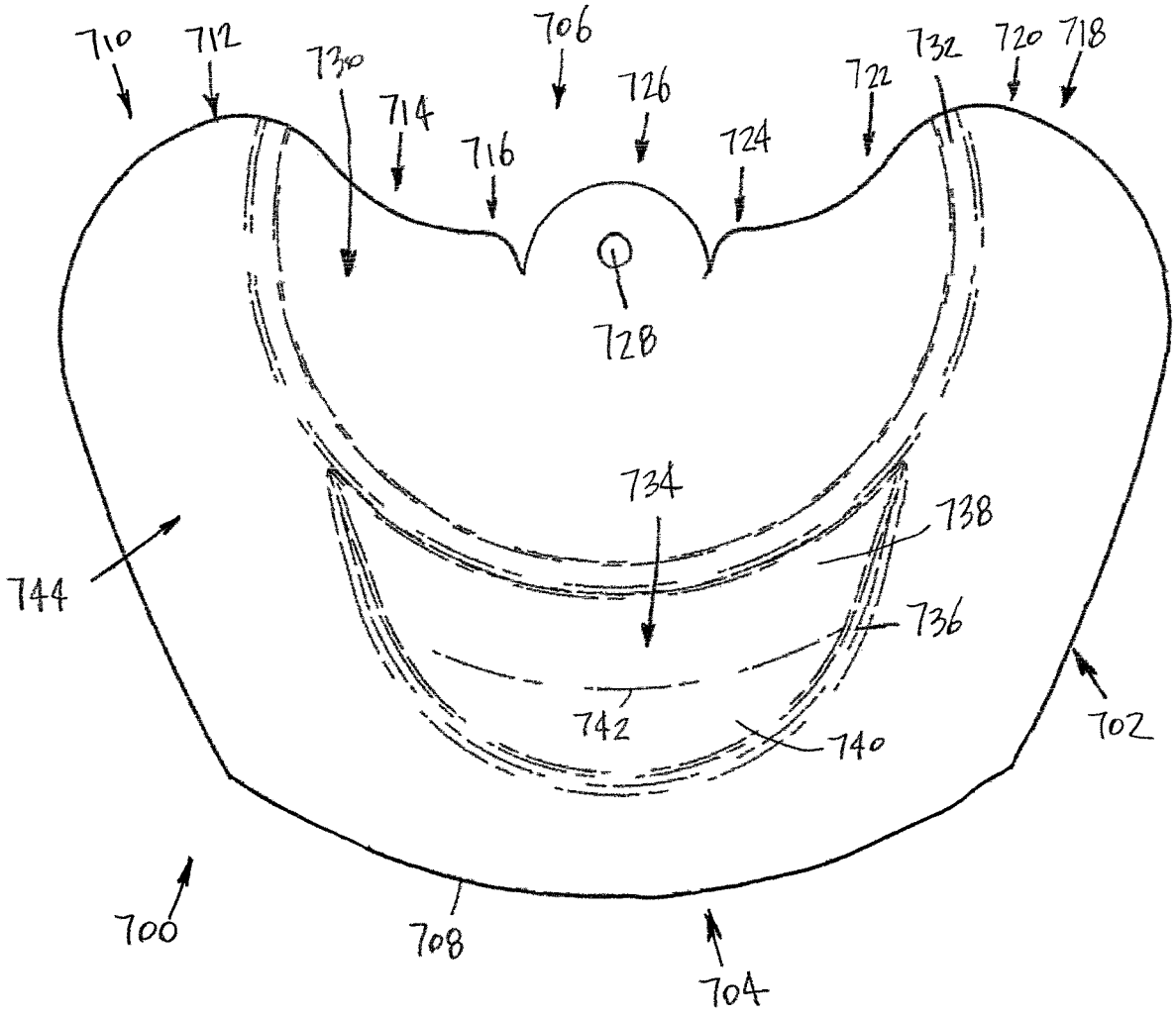
FIG. 29 is a top view of another embodiment of a closure for a beverage can lid constructed according to the present disclosure.

With particular reference now to FIG. 29, another embodiment of a cover or a closure for a beverage can 700 is illustrated. The closure 700 comprises a body 702 having a back end 704 and a front end 706. The back end 704 has a curved or arcuate edge 708 that is used to ride, slide, or move along a rim (not shown) of a beverage can lid (not shown). The front end 706 has a first or left tooth or ear section 710 having a first or left rounded section 712, a first or left indented portion 714, and a first or left lobe section 716. The front end 706 also has a second or right tooth or ear section 718 having a second or right rounded section 720, a second or right indented portion 722, and a second or right lobe section 724. A central rounded section 726 is formed or positioned between the first ear section 710 and the second ear section 718 and extends out from the body 702. The central rounded section 726 has a rivet opening 728 formed therein for receiving a rivet (not shown), as has been explained with respect to FIGS. 19-21. The body 702 has a first central section 730 having a first step down section 732. The first step down section 732 is curved or arcuate in shape and spans from the first ear section 710 to the second ear section 718. The body 702 also has a second central section 734 having a second step down section 736. The second step down section 736 is also curved or arcuate in shape. The central sections 730 and 734 and the step down sections 732 and 736 are adapted to fit within various indentations formed in a beverage can lid (not shown), as has previously been above described. The second central section 734 also has a front section 738 and a rear section 740. The front section 738 is higher than the rear section 740. A line 742 is shown marking the change between the higher front section 738 and the lower rear section 740. The body 702 also has an outer arcuate section 744 formed between the curved edge 708 and the first central section 730 and the second central section 734 The closure 700 is of unitary construction in that the body 702 is formed from one piece of material, such as aluminum.

Figure 30:
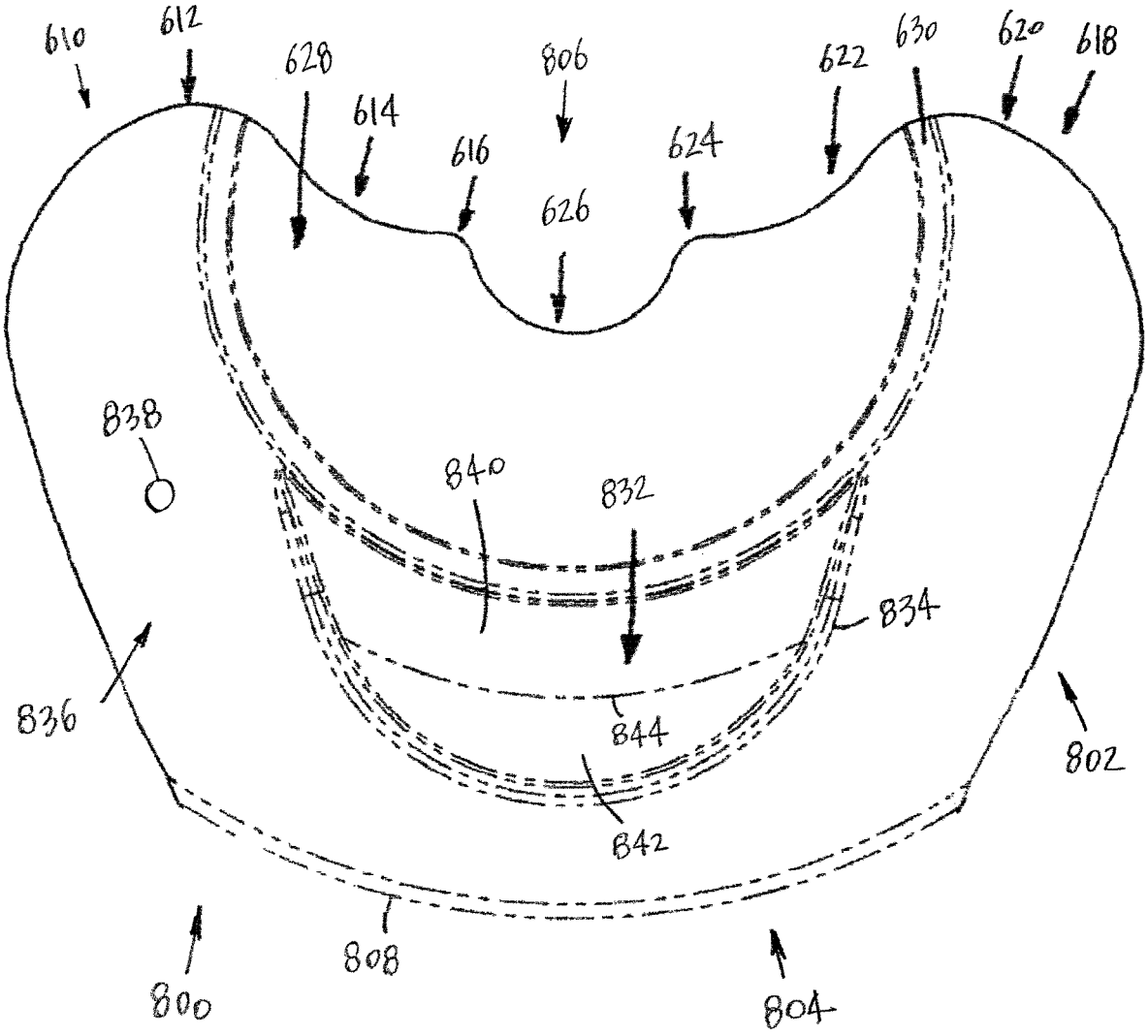
FIG. 30 is a top view of another embodiment of a closure for a beverage can lid constructed according to the present disclosure.

FIG. 30 illustrates another embodiment of a cover or a closure for a beverage can 800. The closure 800 comprises a body 802 having a back end 804 and a front end 806. The back end 804 has a curved or arcuate edge 808 that is used to ride, slide, or move along a rim (not shown) of a beverage can lid (not shown). The curved edge 808 is held in place against or underneath the rim. The front end 806 has a first or left tooth or ear section 810 having a first or left rounded section 812, a first or left indented portion 814, and a first or left lobe section 816. The front end 806 also has a second or right tooth or ear section 818 having a second or right rounded section 820, a second or right indented portion 822, and a second or right lobe section 824. A central rounded recess or slot 826 is formed or positioned between the first ear section 810 and the second ear section 818. The body 802 has a first central section 828 having a first step down section 830. The first step down section 830 is curved or arcuate in shape and spans from the first ear section 810 to the second ear section 818. The body 802 also has a second central section 832 having a second step down section 834. The second step down section 834 is also curved or arcuate in shape. The central sections 828 and 832 and the step down sections 830 and 834 are adapted to fit within various indentations formed in a beverage can lid (not shown), as has been discussed. The body 802 also has an outer arcuate section 836 formed between the curved edge 808 and the first central section 828 and the second central section 832. The outer arcuate section 836 has a rivet opening 838 formed therein. The rivet opening 838 is adapted to accept there through a second rivet (not shown), such as the second rivet 662 shown in FIGS. 27 and 28. The second central section 832 also has a front section 840 and a rear section 842. The front section 840 is higher than the rear section 842. A line 844 is shown marking the change between the higher front section 840 and the lower rear section 842. The closure 800 may be formed from one piece of material, such as aluminum.

Preferably, the closures for a beverage can lid 10, 100, 200, 300, 500, 600, 700, and 800 will be constructed of a relatively lightweight material so that it can be easily used and manufactured. By way of example only, the closures 10, 100, 200, 300, 500, 600, 700, and 800 may be constructed of aluminum or an aluminum alloy. Further, the closures for a beverage can lid 10, 100, 200, 300, 500, 600, 700, and 800 may have a thickness with such thickness being less that the thickness of a beverage can lid. This may lead to the closures for a beverage can lid 10, 100, 200, 300, 500, 600, 700, and 800 costing less than the beverage can lid to manufacture.

Although it has been indicated herein that the closures for a beverage can lid 10, 100, 200, 300, 500, 600, 700, and 800 are used with cans that contain a liquid, such as a carbonated beverage, it is also possible and contemplated that the cans may contain other items such as non-carbonated beverages, powders, spices, foods, syrups, gums, candies, or any other item that can be removed from an opening in the lids and may need to be resealed or closed.

From all that has been said, it will be clear that there has thus been shown and described herein a closure for a beverage can lid which fulfills the various objects and advantages sought therefor. It will be apparent to those skilled in the art, however, that many changes, modifications, variations, and other uses and applications of the subject closure for a beverage can lid are possible and contemplated. All changes, modifications, variations, and other uses and applications which do not depart from the spirit and scope of the disclosure are deemed to be covered by the disclosure, which is limited only by the claims which follow.

What is claimed is:

1. A closure for a beverage can lid comprising:

a body having a back end and a front end with the front end having a first ear section having a first rounded section, a first indented portion, and a first lobe section, a second ear section having a second rounded section, a second indented portion, and a second lobe section, a central rounded section extending out from the body and having a rivet opening formed therein and the central rounded section positioned between the first ear section and the second ear section, a first central section having a first step down section, and a second central section having a second step down section.

2. The closure for a beverage can lid of claim 1 wherein the second central section comprises a front section and a rear section.

3. The closure for a beverage can lid of claim 1 wherein the second central section comprises a front section and a rear section with the front section being higher than the rear section.

4. The closure for a beverage can lid of claim 1 wherein the back end comprises a curved edge.

5. The closure for a beverage can lid of claim 1 wherein the front end is wider than the back end.

6. The closure for a beverage can lid of claim 1 wherein the closure is constructed of a relatively lightweight material.

7. The closure for a beverage can lid of claim 1 wherein the closure is constructed of aluminum.

8. A closure for a beverage can lid comprising:

a body having a back end having a curved edge and a front end with the front end having a first ear section having a first rounded section, a first indented portion, and a first lobe section, a second ear section having a second rounded section, a second indented portion, and a second lobe section, a central rounded recess positioned between the first ear section and the second ear section, a first central section having a first step down section, and a second central section having a second step down section, and an outer arcuate section formed between the curved edge and the first central section and the second central section and extending from the first rounded section of the first ear section to the second rounded section of the second ear section.

9. The closure for a beverage can lid of claim 8 wherein the back end is narrower than the front end.

10. The closure for a beverage can lid of claim 8 wherein the second central section comprises a front section and a rear section with the front section being higher than the rear section.

11. The closure for a beverage can lid of claim 8 wherein the front end is wider than the back end.

12. The closure for a beverage can lid of claim 8 wherein the closure is constructed of a relatively lightweight material.

13. The closure for a beverage can lid of claim 8 wherein the closure is constructed of aluminum.

14. A closure for a beverage can lid comprising:

a body having a back end and a front end with the front end having a first ear section having a first rounded section, a first indented portion, and a first lobe section, a second ear section having a second rounded section, a second indented portion, and a second lobe section, a central rounded recess positioned between the first ear section and the second ear section, a first central section having a first step down section, a second central section having a second step down section, and an outer arcuate section formed between the back end and the first central section and the second central section with the outer arcuate section having a slot formed therein.

15. The closure for a beverage can lid of claim 14 wherein the second central section comprises a front section and a rear section.

16. The closure for a beverage can lid of claim 14 wherein the second central section comprises a front section and a rear section with the front section being higher than the rear section.

17. The closure for a beverage can lid of claim 14 wherein the second central section comprises a front section and a rear section with the front section being higher than the rear section and a line between the higher front section and the lower rear section marking a change between the higher front section and the lower rear section.

18. The closure for a beverage can lid of claim 14 wherein the front end is wider than the back end.

19. The closure for a beverage can lid of claim 14 wherein the closure is constructed of a relatively lightweight material.

20. The closure for a beverage can lid of claim 14 wherein the closure is constructed of aluminum.

* * * * *